US006146800A

United States Patent [19]

Yoshida et al.

[11] Patent Number: 6,146,800

[45] Date of Patent: Nov. 14, 2000

[54] ELECTROPHOTOGRAPHIC PHOTOSENSITIVE MEMBER, PROCESS CARTRIDGE, AND ELECTROPHOTOGRAPHIC APPARATUS

[75] Inventors: Akira Yoshida; Hideki Anayama, both of Yokohama, Japan

[73] Assignee: Canon Kabushiki Kaisha, Tokyo, Japan

[21] Appl. No.: 09/173,440

[22] Filed: Oct. 16, 1998

[30] Foreign Application Priority Data

Oct. 17, 1997 [JP] Japan ..... 9-285262
Oct. 17, 1997 [JP] Japan ..... 9-285263

[51] Int. Cl.[7] ..... G03G 5/14

[52] U.S. Cl. ..... 430/67; 430/66; 430/96; 430/56; 399/116; 399/159

[58] Field of Search ..... 430/59.6, 96, 56, 430/66, 67; 399/159, 116; 525/437, 461

[56] References Cited

U.S. PATENT DOCUMENTS

| | | | |
|---|---|---|---|
| 3,837,851 | 9/1974 | Shattuck et al. . | |
| 3,871,880 | 3/1975 | Montillier . | |
| 3,935,154 | 1/1976 | Cawley | 260/33.8 |
| 5,104,757 | 4/1992 | Koyama et al. | 430/60 |
| 5,254,423 | 10/1993 | Mayama et al. | 430/58 |
| 5,418,099 | 5/1995 | Mayama et al. | 430/58 |
| 5,876,888 | 3/1999 | Anayama et al. | 430/58 |
| 5,876,892 | 3/1999 | Fujimori et al. | 430/59.6 |

FOREIGN PATENT DOCUMENTS

| | | |
|---|---|---|
| 0428209 | 5/1991 | European Pat. Off. . |
| 0500087 | 8/1992 | European Pat. Off. . |
| 56-167759 | 12/1981 | Japan . |
| 61-228453 | 10/1986 | Japan . |
| 61-272754 | 12/1986 | Japan . |
| 5-072753 | 3/1993 | Japan . |
| 6-051544 | 2/1994 | Japan . |
| 6-075415 | 3/1994 | Japan . |
| 6-136108 | 5/1994 | Japan . |

*Primary Examiner*—Janis L. Dote
*Attorney, Agent, or Firm*—Fitzpatrick, Cella, Harper & Scinto

[57] ABSTRACT

An electrophotographic photosensitive member is disclosed which is provided with a surface layer containing a polyarylate resin or polycarbonate resin. The polyarylate resin and polycarbonate resin have a structural unit having a cyclic siloxane structure in its backbone chain. Also a process cartridge and an electrophotographic apparatus using the photosensitive member are disclosed.

27 Claims, 1 Drawing Sheet

FIGURE
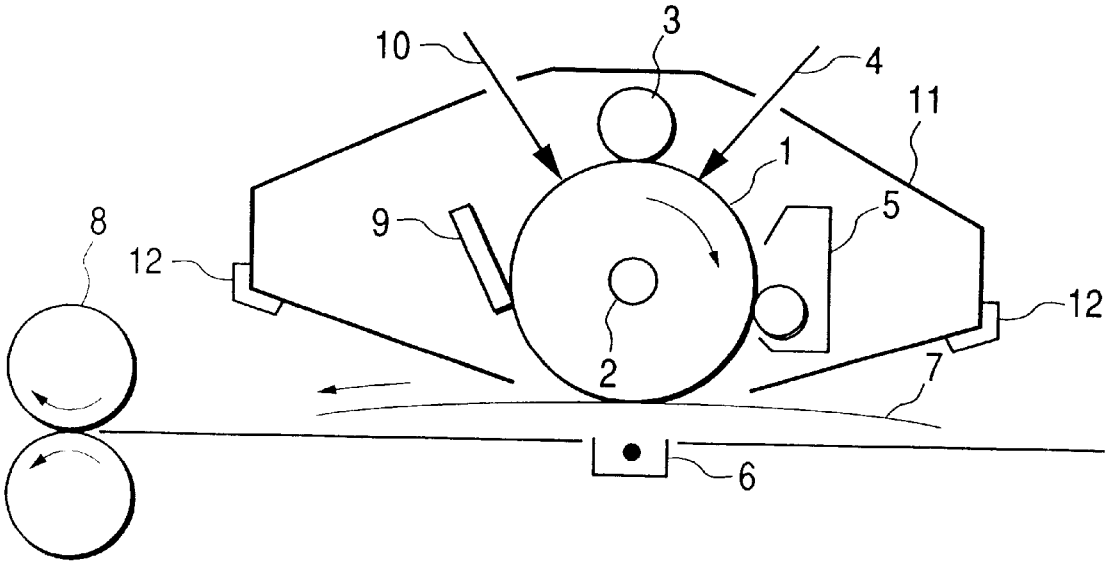

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

This invention relates to an electrophotographic photosensitive member, and a process cartridge and an electrophotographic apparatus which have the electrophotographic photosensitive member. More particularly, it relates to an electrophotographic photosensitive member having a surface layer containing a specific resin, and a process cartridge and an electrophotographic apparatus which have such electrophotographic photosensitive member.

2. Related Background Art

In recent years, electrophotographic photosensitive members having various organic photoconductive compounds are brought forth energetically. For example, U.S. Pat. No. 3,837,851 discloses a photosensitive member having a charge transport layer containing triarylpyrazoline, and U.S. Pat. No. 3,871,880 discloses a photosensitive member having a charge generation layer and a charge transport layer, the former containing a derivative of a perylene pigment.

The organic photoconductive compounds have their own different wavelength regions where they are sensitive. For example, Japanese Patent Applications Laid-open No. 61-272754 and No. 56-167759 disclose compounds having a high sensitivity at the visible region, and Japanese Patent Applications Laid-open No. 57-19576 and No. 61-228453 disclose compounds having a sensitivity up to the infrared region. Of these materials, those having a sensitivity at the infrared region are used in laser beam printers and LED printers, and the demand for them and its frequency are increasing.

Meanwhile, as a matter of course, electrophotographic photosensitive members are required to have sensitivities, electrical properties, mechanical properties and also optical properties which are suited for electrophotographic processes to be applied. In particular, since electrical and mechanical force of charging, exposure, development, transfer, cleaning and so forth is applied directly to the surfaces of electrophotographic photosensitive members repeatedly used, the photosensitive members are required to have a durability thereto.

Stated specifically, the photosensitive members are required to have a durability against deterioration caused by ozone and nitrogen oxide generated at the time of charging and against electrical and mechanical deterioration such as surface wear and scratches caused by discharging and cleaning. In particular, to improve the durability of organic photosensitive members most of which have a relatively low hardness, the lubricity of photosensitive member surfaces and the strength of resins used are given as important factors therefor.

With regard to the improvement in the lubricity, Japanese Patent Applications Laid-open No. 5-72753, No. 6-51544, No. 6-75415 and No. 6-136108 propose a method in which a siloxane chain is copolymerized on the backbone chain of polycarbonate.

However, in some cases, an attempt to improve the lubricity by straight-chain copolymerization of a conventional siloxane structure on the backbone chain of polycarbonate has resulted in a lowering of the mechanical strength inherent in polycarbonate resins, which may differ depending on its weight ratio. Wear resistance depends on the strength and lubricity of surface layers, and hence, in order to improve the durability (running performance) of photosensitive members, it is necessary to achieve both the improvement in lubricity and the prevention of resin strength from lowering.

As another problem, virgin photosensitive members have so greatly uniform surfaces that they may have a high adhesion to cleaning blades (after they have begun to be used, the photosensitive member surfaces and cleaning blades are a little improved in lubricity because the surface is scraped to become rough or the toner and wear powder become present). Accordingly, troubles such as blade turnover and blade squeak tend to occur unless their lubricity is kept high at the service initial stage. In particular, since their surfaces have a high coefficient of friction in an environment of high humidity, this problem is remarkable not only at the initial stage but also during service.

The introduction of a straight-chain siloxane chain also makes the internal stress of a polymer film relax to bring about an improvement in solvent cracking resistance, but still tends to result in a low mechanical strength.

SUMMARY OF THE INVENTION

An object of the present invention is to provide an electrophotographic photosensitive member that has superior lubricity, strength and solvent cracking resistance, has a long lifetime and can form a high image quality, and a process cartridge and an electrophotographic apparatus which have such electrophotographic photosensitive member.

That is, the present invention provides an electrophotographic photosensitive member comprising a support and a photosensitive layer provided on the support;

the electrophotographic photosensitive member having a surface layer which contains a polyarylate resin or polycarbonate resin having a structural unit having a cyclic siloxane structure in its backbone chain.

The present invention also provides a process cartridge and an electrophotographic apparatus which have the electrophotographic photosensitive member described above.

BRIEF DESCRIPTION OF THE DRAWING

The single Figure schematically illustrates an example of the construction of an electrophotographic apparatus having a process cartridge having the electrophotographic photosensitive member of the present invention.

DESCRIPTION OF THE PREFERRED EMBODIMENTS

The electrophotographic photosensitive member of the present invention has a surface layer which contains a polyarylate resin or polycarbonate resin having a structural unit having a cyclic siloxane structure in its backbone chain.

In the present invention, the siloxane chain is cyclic. This has enabled an improvement in stress relaxation and surface lubricity while restraining mechanical strength from lowering.

The cyclic siloxane structure in the present invention refers to a structure wherein the siloxane chain forms a ring. This structure is present as not the side chain but the backbone chain, of a structural unit the polyarylate resin or polycarbonate resin has. Stated more specifically, this structure is present as the backbone chain between phenyl groups at the both terminals a bisphenol used when the polyarylate resin or polycarbonate resin is synthesized has.

In the case when the surface layer contains the polyarylate resin, the structural unit having a cyclic siloxane structure in the backbone chain may preferably be represented by the following Formula (1).

(1)

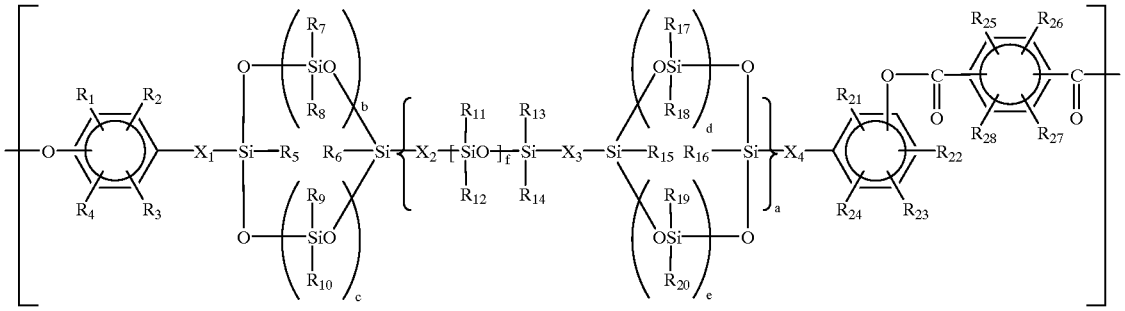

wherein $R_1$ to $R_4$ and $R_{21}$ to $R_{28}$ are the same or different and each represent a hydrogen atom, a halogen atom, a substituted or unsubstituted alkyl group, a substituted or unsubstituted alkoxyl group or a substituted or unsubstituted aryl group; $R_5$ to $R_{20}$ are the same or different and each represent a hydrogen atom, a halogen atom, a substituted or unsubstituted alkyl group or a substituted or unsubstituted aryl group; $X_1$ to $X_4$ are the same or different and each represent a substituted or unsubstituted alkylene group; a represents an integer of 0 to 100; b, c, d and e are the same or different and each represent an integer which is 0 to 10 and is $b+c \geqq 2$ and $d+e \geqq 2$; and f represents an integer of 0 to 10.

In Formula (1), the halogen atom may include a fluorine atom, a chlorine atom and a bromine atom. The alkyl group may include a methyl group, an ethyl group, a propyl group and a butyl group. The alkoxyl group may include a methoxyl group, an ethoxyl group, a propoxyl group and a butoxyl group. The aryl group may include a phenyl group and a naphthyl group. The alkylene group may include a methylene group, an ethylene group and a propylene group.

The substituent the above alkyl group, alkoxyl group, aryl group and alkylene group may each have may include alkyl groups such as a methyl group, an ethyl group, a propyl group and a butyl group, aryl groups such as a phenyl group and a naphthyl group, and halogen atoms such as a fluorine atom, a chlorine atom and a bromine atom.

In Formula (1), the group —O— at the left terminal may be bonded at any of ortho-, meta- and para-positions with respect to $X_1$, and the group

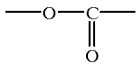

at the right terminal may be bonded at any of ortho-, meta- and para-positions with respect to the group

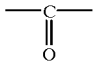

These are depicted as shown in the above formula for the sake of convenience. The same applies also to the group —O— bonded to the benzene ring bonded to $X_4$.

In the present invention, in view of the strength and the sensitivity of the electrophotographic photosensitive member obtained, $R_1$ to $R_4$ and $R_{21}$ to $R_{28}$ may preferably be all hydrogen atoms.

In the present invention, in order for the mechanical strength to be exhibited preferentially, the number of SiO that forms the siloxane ring in the structural unit represented by Formula (1) may preferably be 4 to 8 and the number of the siloxane ring may preferably be 1 ($a=0$, $2 \leqq b+c \leqq 6$).

In the present invention, in view of the mechanical strength, the polyarylate resin may preferably further have a structural unit represented by the following Formula (2).

(2)

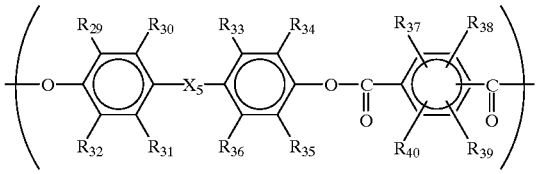

wherein $R_{29}$ to $R_{40}$ are the same or different and each represent a hydrogen atom, a halogen atom, a substituted or unsubstituted alkyl group or a substituted or unsubstituted aryl group; $X_5$ represents a single bond, —O—, —S— or a group represented by the following formula:

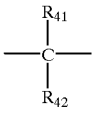

wherein $R_{41}$ and $R_{42}$ are the same or different and each represent a hydrogen atom, a halogen atom, a substituted or unsubstituted alkyl group or a substituted or unsubstituted aryl group; or $R_{41}$ and $R_{42}$ may be joined together to form a substituted or unsubstituted cycloalkylidene group together with the intervening carbon atom.

In Formula (2), the halogen atom, the alkyl group and the aryl group may include the same atoms or groups as those in Formula (1). The cycloalkylidene group may include a cyclopentylidene group, a cyclohexylidene group and a cycloheptylidene group. The substituent these groups may each have may include the same substituents as those in Formula (1).

In Formula (2), the group

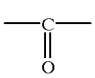

at the right terminal may be bonded at any of ortho-, meta- and para-positions with respect to the group

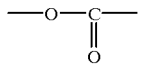

on the left side.

In the present invention, $R_{30}$, $R_{31}$, $R_{33}$, $R_{36}$ to $R_{39}$ and $R_{40}$ may preferably be all hydrogen atoms.

In the case when the surface layer contains the polycarbonate resin, the structural unit having a cyclic siloxane structure in the backbone chain may preferably be represented by the following Formula (3).

In the present invention, in view of the strength and the sensitivity of the electrophotographic photosensitive member obtained, $R_{43}$ to $R_{46}$ and $R_{63}$ to $R_{66}$ may preferably be all hydrogen atoms.

In order for the mechanical strength to be exhibited preferentially, the number of SiO that forms the siloxane ring in the structural unit represented by Formula (3) may preferably be 4 to 8 and the number of the siloxane ring may preferably be 1 ($g=0$, $2 \leqq h+i \leqq 6$).

In the present invention, in view of the mechanical strength, the polycarbonate resin may preferably further have a structural unit represented by the following Formula (4).

(3)

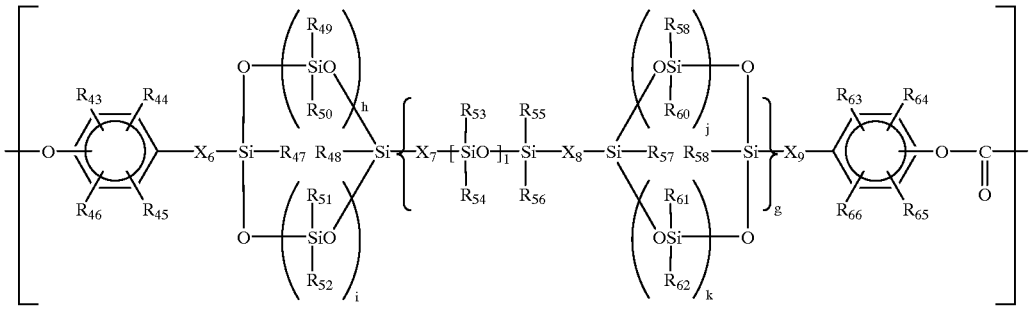

wherein $R_{43}$ to $R_{46}$ and $R_{63}$ to $R_{66}$ are the same or different and each represent a hydrogen atom, a halogen atom, a substituted or unsubstituted alkyl group, a substituted or unsubstituted alkoxyl group or a substituted or unsubstituted aryl group; $R_{47}$ to $R_{62}$ are the same or different and each represent a hydrogen atom, a halogen atom, a substituted or unsubstituted alkyl group or a substituted or unsubstituted aryl group; $X_6$ to $X_9$ are the same or different and each represent a substituted or unsubstituted alkylene group; g represents an integer of 0 to 100; h, i, j and k are the same or different and each represent an integer which is 0 to 10 and is $h+i \geqq 2$ and $j+k \geqq 2$; and l represents an integer of 0 to 10.

In Formula (3), the halogen atom may include a fluorine atom, a chlorine atom and a bromine atom. The alkyl group may include a methyl group, an ethyl group, a propyl group and a butyl group. The alkoxyl group may include a methoxyl group, an ethoxyl group, a propoxyl group and a butoxyl group. The aryl group may include a phenyl group and a naphthyl group. The alkylene group may include a methylene group, an ethylene group and a propylene group.

The substituent the above alkyl group, alkoxyl group, aryl group and alkylene group may each have may include alkyl groups such as a methyl group, an ethyl group, a propyl group and a butyl group, aryl groups such as a phenyl group and a naphthyl group, and halogen atoms such as a fluorine atom, a chlorine atom and a bromine atom.

In Formula (3), the group —O— at the left terminal may be bonded at any of ortho-, meta- and para-positions with respect to $X_6$, and the group

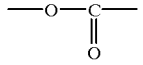

at the right terminal may be bonded at any of ortho-, meta- and para-positions with respect to the group —$X_9$—. These are depicted as shown in the above formula for the sake of convenience.

(4)

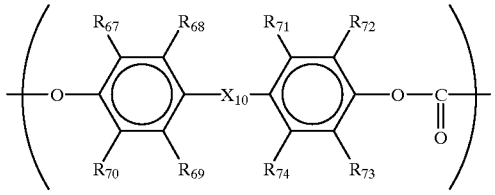

wherein $R_{67}$ to $R_{74}$ are the same or different and each represent a hydrogen atom, a halogen atom, a substituted or unsubstituted alkyl group or a substituted or unsubstituted aryl group; $X_{10}$ represents a single bond, —O—, —S— or a group represented by the following formula:

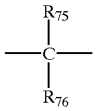

wherein $R_{75}$ and $R_{76}$ are the same or different and each represent a hydrogen atom, a halogen atom, a substituted or unsubstituted alkyl group or a substituted or unsubstituted aryl group; or $R_{75}$ and $R_{76}$ may be joined together to form a substituted or unsubstituted cycloalkylidene group together with the intervening carbon atom.

In Formula (4), the halogen atom, the alkyl group and the aryl group may include the same atoms or groups as those in Formula (3). The cycloalkylidene group may Uinclude, for example, a cyclohexylidene group. The substituent these groups may each have may include the same substituents as those in Formula (3).

In the present invention, $R_{68}$, $R_{69}$, $R_{71}$ and $R_{74}$ may preferably be all hydrogen atoms.

Preferred examples of the structural unit represented by Formula (1) are shown in Table 1 [Table 1(A)–1(B)] below. The present invention is by no means limited to these. In Table 1, letter symbol "—ph" represents a phenyl group, and sign (") indicates "ditto".

TABLE 1

| No. | $X_1$, $X_4$ | $X_2$, $X_3$ | $R_1$–$R_4$ | $R_5$, $R_6$, $R_{15}$, $R_{16}$ | $R_7$, $R_9$, $R_{17}$, $R_{19}$ | $R_8$, $R_{10}$ $R_{18}$, $R_{20}$ | $R_{11}$, $R_{13}$ | $R_{12}$, $R_{14}$ |
|---|---|---|---|---|---|---|---|---|
| (1)-1 | —$CH_2$— | — | all: H | —$CH_3$ | —$CH_3$ | —$CH_3$ | — | — |
| -2 | —$C_2H_4$— | — | " | " | " | " | — | — |
| -3 | —$C_3H_6$— | — | " | " | " | " | — | — |
| -4 | —$C_4H_8$— | — | " | " | " | " | — | — |
| -5 | —$C_5H_{10}$— | — | " | " | " | " | — | — |
| -6 | —$CH_2$— | — | " | " | " | —$C_2H_5$ | — | — |
| -7 | —$C_2H_4$— | — | " | " | " | " | — | — |
| -8 | —$C_3H_6$— | — | " | " | " | " | — | — |
| -9 | —$CH_2$— | — | " | " | " | -ph | — | — |
| -10 | —$C_2H_4$— | — | " | " | " | " | — | — |
| -11 | " | — | " | —$C_2H_5$ | " | —$C_3H_7$ | — | — |
| -12 | " | — | " | " | —$C_2H_5$ | —$C_2H_5$ | — | — |
| -21 | —$CH_2$— | —$CH_2$— | " | —$CH_3$ | —$CH_3$ | —$CH_3$ | —$CH_3$ | —$CH_3$ |
| -22 | " | " | " | " | " | " | " | " |
| -23 | " | " | " | " | " | " | " | " |
| -24 | " | " | " | " | " | " | " | " |
| -25 | " | " | " | " | " | " | " | " |
| -26 | " | " | " | " | " | " | " | " |
| -27 | " | " | " | " | " | " | " | " |
| -28 | —$C_2H_4$— | " | " | " | " | " | " | " |
| -29 | " | " | " | " | " | " | " | " |
| -30 | " | " | " | " | " | " | " | " |
| -31 | —$C_3H_6$— | " | " | " | " | " | " | " |
| -32 | " | " | " | " | " | " | " | " |
| -33 | —$C_4H_8$— | " | " | " | " | " | " | " |
| -34 | —$C_5H_{10}$— | " | " | " | " | " | " | " |
| -35 | —$C_2H_4$— | —$C_2H_4$— | " | " | " | " | " | " |
| -36 | " | —$C_3H_6$— | " | " | " | " | " | " |
| -37 | " | " | " | " | " | —$C_2H_5$ | " | " |
| -38 | —$C_3H_6$— | —$C_2H_4$— | all: H | —$CH_3$ | —$CH_3$ | —$CH_3$ | —$CH_3$ | —$CH_3$ |
| -39 | " | " | " | " | " | —$C_2H_5$ | " | " |
| -40 | " | —$C_3H_6$— | " | " | " | —$CH_3$ | " | " |
| -41 | " | " | " | " | " | —$C_2H_5$ | " | " |
| -42 | " | " | " | " | " | -ph | " | " |
| -43 | —$C_2H_4$— | —$CH_2$— | " | " | " | —$CH_3$ | " | -ph |
| -44 | " | " | " | " | " | —$CF_3$ | " | —$CH_3$ |
| -45 | " | " | " | " | " | —Cl | " | " |
| -46 | " | " | " | " | " | —$CH_3$ | " | —$CF_3$ |
| -47 | " | " | " | " | " | " | " | —Cl |
| -51 | —$CH_2$— | — | " | " | " | " | — | — |
| -52 | " | — | " | " | " | " | — | — |
| -53 | " | — | " | " | " | " | — | — |
| -54 | —$C_2H_4$— | —$CH_2$— | " | " | " | " | —$CH_3$ | —$CH_3$ |
| -55 | " | " | " | " | " | " | " | " |
| -56 | " | " | " | " | " | " | " | " |
| -57 | " | " | " | " | " | " | " | " |
| -58 | " | " | " | " | " | " | " | " |
| -59 | " | " | " | " | " | " | " | " |
| -60 | " | " | " | " | " | " | " | " |
| -61 | " | " | " | —$C_2H_5$ | " | —$C_2H_5$ | " | " |
| -62 | —$CH_2$— | — | $R_1$: —$CH_3$ others: H | —$CH_3$ | " | —$CH_3$ | — | — |
| -63 | " | — | $R_1$: —$OCH_3$ others: H | " | " | " | — | — |
| -64 | —$C_2H_4$— | — | $R_1$: —$OCH_3$ others: H | " | " | " | — | — |
| -65 | —$C_3H_6$— | — | $R_1$: —$OCH_3$ others: H | " | " | —$C_2H_5$ | — | — |
| -66 | " | —$CH_2$— | $R_1$: —$OCH_3$ others: H | " | " | " | —$CH_3$ | —$CH_3$ |
| -67 | —$CH_2$— | " | $R_1$: —$CH_3$ others: H | " | " | " | " | " |
| -68 | —$C_2H_4$— | $R_1$: —$CH_3$ | " others: H | " | " | " | " | " |

| No. | $R_{21}$–$R_{24}$ | $R_{25}$–$R_{28}$ | a | b | c | d | e | f |
|---|---|---|---|---|---|---|---|---|
| (1)-1 | all: H | all: H | 0 | 1 | 1 | — | — | — |
| -2 | " | " | 0 | 1 | 1 | — | — | — |
| -3 | " | " | 0 | 1 | 1 | — | — | — |
| -4 | " | " | 0 | 1 | 1 | — | — | — |

TABLE 1-continued

| | | | | | | | | |
|---|---|---|---|---|---|---|---|---|
| -5 | " | " | 0 | 1 | 1 | — | — | — |
| -6 | " | " | 0 | 1 | 1 | — | — | — |
| -7 | " | " | 0 | 1 | 1 | — | — | — |
| -8 | " | " | 0 | 1 | 1 | — | — | — |
| -9 | " | " | 0 | 1 | 1 | — | — | — |
| -10 | " | " | 0 | 1 | 1 | — | — | — |
| -11 | " | " | 0 | 1 | 1 | — | — | — |
| -12 | " | " | 0 | 1 | 1 | — | — | — |
| -21 | " | " | 1 | 1 | 1 | 1 | 1 | 1 |
| -22 | " | " | 2 | 1 | 1 | 1 | 1 | 1 |
| -23 | " | " | 5 | 1 | 1 | 1 | 1 | 1 |
| -24 | " | " | 10 | 1 | 1 | 1 | 1 | 1 |
| -25 | " | " | 20‘1 | 1 | 1 | 1 | 1 | 1 |
| -26 | " | " | 40 | 1 | 1 | 1 | 1 | 1 |
| -27 | " | " | 80 | 1 | 1 | 1 | 1 | 1 |
| -28 | " | " | 1 | 1 | 1 | 1 | 1 | 1 |
| -29 | " | " | 2 | 1 | 1 | 1 | 1 | 1 |
| -30 | " | " | 10 | 1 | 1 | 1 | 1 | 1 |
| -31 | " | " | 1 | 1 | 1 | 1 | 1 | 1 |
| -32 | " | " | 5 | 1 | 1 | 1 | 1 | 1 |
| -33 | " | " | 1 | 1 | 1 | 1 | 1 | 1 |
| -34 | " | " | 1 | 1 | 1 | — | — | — |
| -35 | " | " | 1 | 1 | 1 | — | — | — |
| -36 | " | " | 1 | 1 | 1 | — | — | — |
| -37 | " | " | 1 | 1 | 1 | — | — | — |
| -38 | all: H | all: H | 1 | 1 | 1 | — | — | — |
| -39 | " | " | 1 | 1 | 1 | — | — | — |
| -40 | " | " | 1 | 1 | 1 | — | — | — |
| -41 | " | " | 1 | 1 | 1 | — | — | — |
| -42 | " | " | 1 | 1 | 1 | — | — | — |
| -43 | " | " | 1 | 1 | 1 | — | — | — |
| -44 | " | " | 1 | 1 | 1 | — | — | — |
| -45 | " | " | 1 | 1 | 1 | — | — | — |
| -46 | " | " | 1 | 1 | 1 | — | — | — |
| -47 | " | " | 1 | 1 | 1 | — | — | — |
| -51 | " | " | 0 | 2 | 2 | — | — | — |
| -52 | " | " | 0 | 3 | 3 | — | — | — |
| -53 | " | " | 0 | 4 | 4 | — | — | — |
| -54 | " | " | 1 | 2 | 2 | 2 | 2 | 1 |
| -55 | " | " | 1 | 2 | 2 | 2 | 2 | 1 |
| -56 | " | " | 10 | 2 | 2 | 2 | 2 | 1 |
| -57 | " | " | 20 | 2 | 2 | 2 | 2 | 1 |
| -58 | " | " | 1 | 3 | 3 | 2 | 2 | 1 |
| -59 | " | " | 1 | 3 | 1 | 3 | 1 | 2 |
| -60 | " | " | 1 | 4 | 1 | 4 | 1 | 6 |
| -61 | " | " | 2 | 1 | 1 | 1 | 1 | 10 |
| -62 | $R_{23}$: —$CH_3$ others: H | $R_{25}$: —$CH_3$ others: H | 0 | 1 | 1 | — | — | — |
| -63 | $R_{23}$:—$OCH_3$ others: H | all: H | 0 | 1 | 1 | — | — | — |
| -64 | $R_{23}$:—$OCH_3$ others: H | " | 0 | 1 | 1 | — | — | — |
| -65 | $R_{23}$:—$OCH_3$ others: H | " | 0 | 1 | 1 | — | — | — |
| -66 | $R_{23}$:—$OCH_3$ others: H | " | 1 | 1 | 1 | 1 | 1 | 1 |
| -67 | $R_{23}$: —$CH_3$ others: H | " | 1 *others: H | 1 | 1 | 1 | 1 | 1 |
| -68 | $R_{23}$: —$CH_3$ others: H | $R_{25}$: —$CH_3$* | 1 | 1 | 1 | 1 | 1 | 1 |

Preferred examples of the structural unit represented by Formula (2) are shown below. The present invention is by no means limited to these.

(2)-1

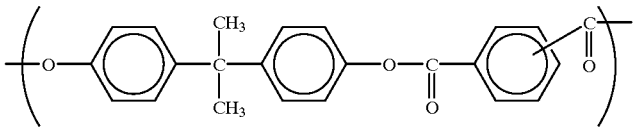

-continued
(2)-2
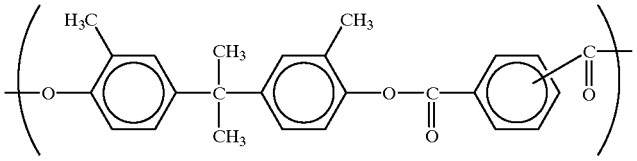
(2)-3
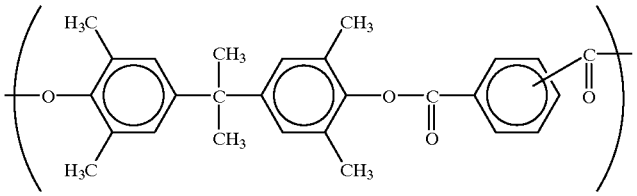
(2)-4
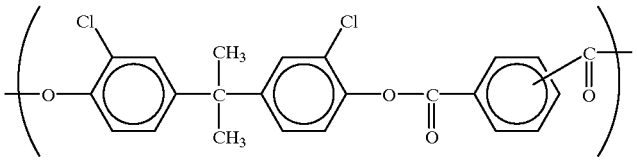
(2)-5
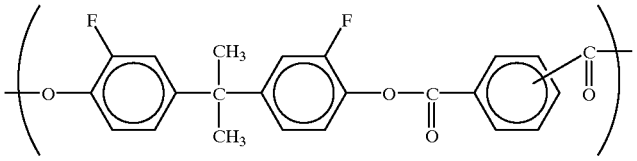
(2)-6
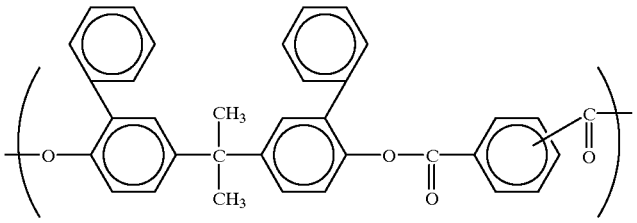
(2)-7
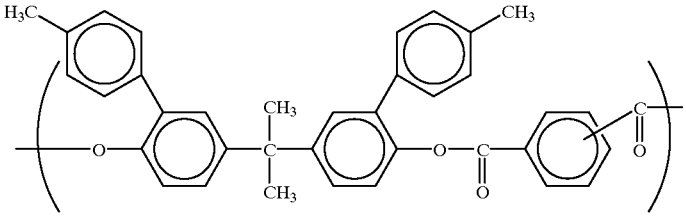
(2)-8
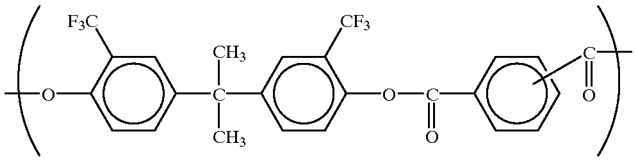
(2)-9
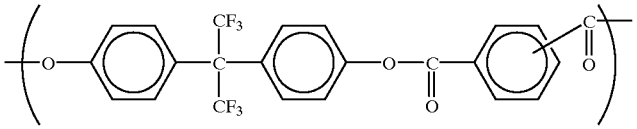

-continued
(2)-10
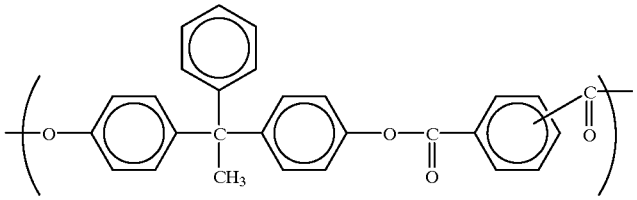
(2)-11
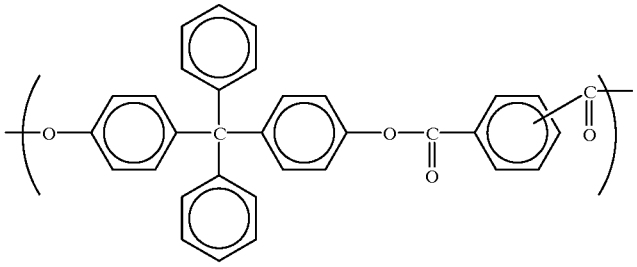
(2)-12
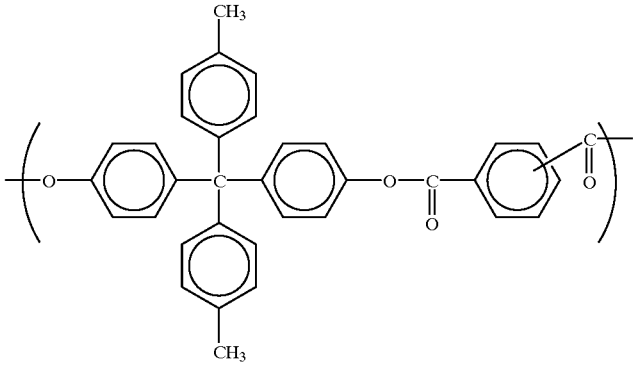
(2)-13
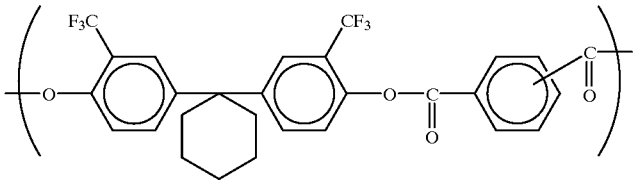
(2)-14
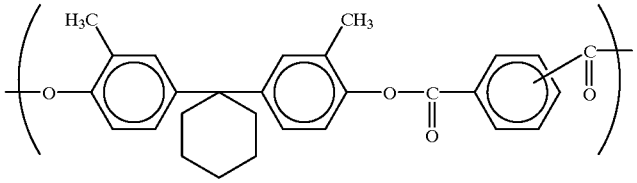
(2)-15
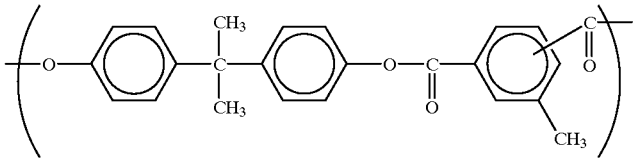

-continued
(2)-16
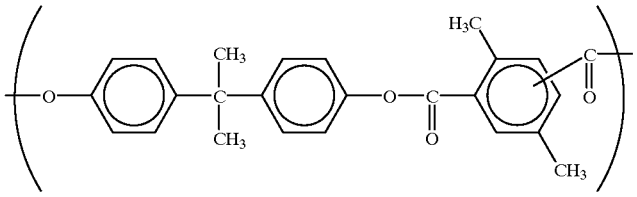
(2)-17
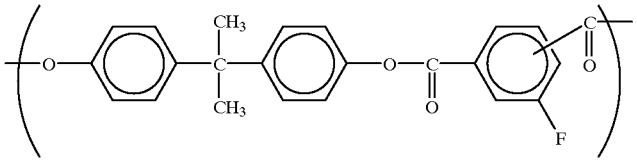
(2)-18
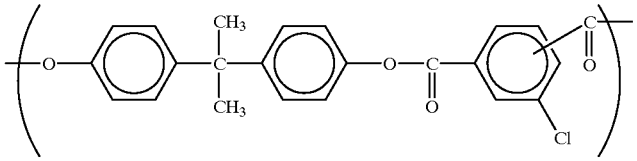
(2)-19
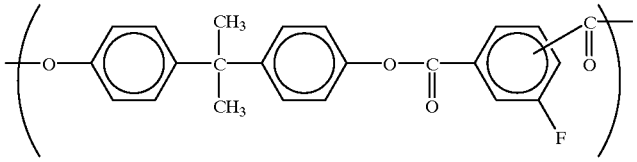
(2)-20
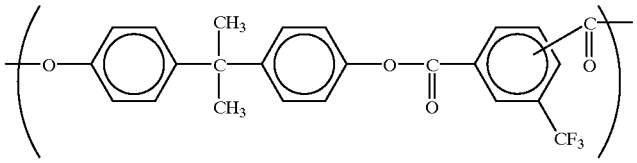
(2)-21
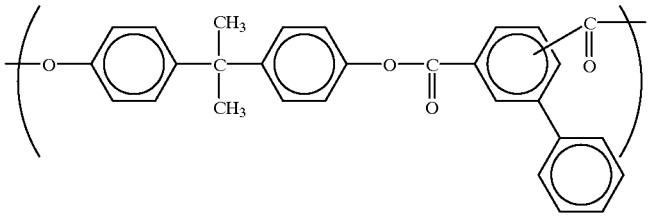
(2)-22
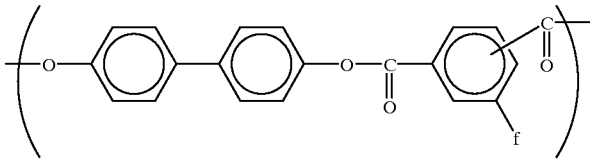
(2)-23
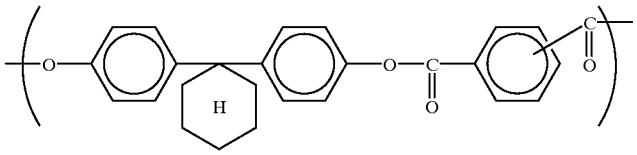

-continued (2)-24

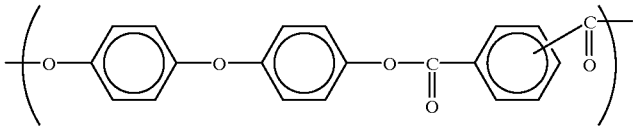

(2)-25

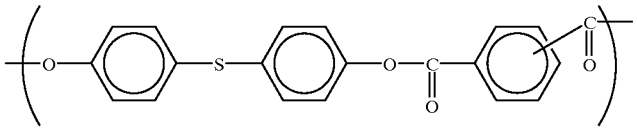

Of these, units (2)-1, (2)-2, (2)-10 and (2)-16 are particularly preferred.

Preferred examples of the structural unit represented by Formula (3) are shown in Table 2 [Table 2(A)-2(B)] below. The present invention is by no means limited to these. In Table 2, letter symbol "—ph" represents a phenyl group, and sign (") indicates "ditto".

TABLE 2

| No. | $X_6$, $X_9$ | $X_7$, $X_8$ | $R_{43}$–$R_{46}$ | $R_{47}$, $R_{48}$, $R_{57}$, $R_{58}$ | $R_{49}$, $R_{51}$, $R_{59}$, $R_{61}$ | $R_{50}$, $R_{52}$ $R_{60}$, $R_{62}$ | $R_{53}$, $R_{55}$ | $R_{54}$, $R_{56}$ |
|---|---|---|---|---|---|---|---|---|
| (3)-1 | —$CH_2$— | — | all: H | —$CH_3$ | —$CH_3$ | —$CH_3$ | — | — |
| -2 | —$C_2H_4$— | — | " | " | " | " | — | — |
| -3 | —$C_3H_6$— | — | " | " | " | " | — | — |
| -4 | —$C_4H_8$— | — | " | " | " | " | — | — |
| -5 | —$C_5H_{10}$— | — | " | " | " | " | — | — |
| -6 | —$CH_2$— | — | " | " | " | —$C_2H_5$ | — | — |
| -7 | —$C_2H_4$— | — | " | " | " | " | — | — |
| -8 | —$C_3H_6$— | — | " | " | " | " | — | — |
| -9 | —$CH_2$— | — | " | " | " | -ph | — | — |
| -10 | —$C_2H_4$— | — | " | " | " | " | — | — |
| -11 | " | — | " | —$C_2H_5$ | " | —$C_3H_7$ | — | — |
| -12 | " | — | " | " | —$C_2H_5$ | —$C_2H_5$ | — | — |
| -21 | —$CH_2$— | —$CH_2$— | " | —$CH_3$ | —$CH_3$ | —$CH_3$ | —$CH_3$ | —$CH_3$ |
| -22 | " | " | " | " | " | " | " | " |
| -23 | " | " | " | " | " | " | " | " |
| -24 | " | " | " | " | " | " | " | " |
| -25 | " | " | " | " | " | " | " | " |
| -26 | " | " | " | " | " | " | " | " |
| -27 | " | " | " | " | " | " | " | " |
| -28 | —$C_2H_4$— | " | " | " | " | " | " | " |
| -29 | " | " | " | " | " | " | " | " |
| -30 | " | " | " | " | " | " | " | " |
| -31 | —$C_3H_6$— | " | " | " | " | " | " | " |
| -32 | " | " | " | " | " | " | " | " |
| -33 | —$C_4H_8$— | " | " | " | " | " | " | " |
| -34 | —$C_5H_{10}$— | " | " | " | " | " | " | " |
| -35 | —$C_2H_4$— | —$C_2H_4$— | " | " | " | " | " | " |
| -36 | " | —$C_3H_6$— | " | " | " | " | " | " |
| -37 | " | " | " | " | " | —$C_2H_5$ | " | " |
| -38 | —$C_3H_6$— | —$C_2H_4$— | all: H | —$CH_3$ | —$CH_3$ | —$CH_3$ | —$CH_3$ | —$CH_3$ |
| -39 | " | " | " | " | " | —$C_2H_5$ | " | " |
| -40 | " | —$C_3H_6$— | " | " | " | —$CH_3$ | " | " |
| -41 | " | " | " | " | " | —$C_2H_5$ | " | " |
| -42 | " | " | " | " | " | -ph | " | " |
| -43 | —$C_2H_4$— | —$CH_2$— | " | " | " | —$CH_3$ | " | -ph |
| -44 | " | " | " | " | " | —$CF_3$ | " | —$CH_3$ |
| -45 | " | " | " | " | " | —Cl | " | " |
| -46 | " | " | " | " | " | —$CH_3$ | " | —$CF_3$ |
| -47 | " | " | " | " | " | " | " | —Cl |
| -51 | —$CH_2$— | — | " | " | " | " | — | — |
| -52 | " | — | " | " | " | " | — | — |
| -53 | " | — | " | " | " | " | — | — |
| -54 | —$C_2H_4$— | —$CH_2$— | " | " | " | " | —$CH_3$ | —$CH_3$ |
| -55 | " | " | " | " | " | " | " | " |
| -56 | " | " | " | " | " | " | " | " |
| -57 | " | " | " | " | " | " | " | " |
| -58 | " | " | " | " | " | " | " | " |
| -59 | " | " | " | " | " | " | " | " |
| -60 | " | " | " | " | " | " | " | " |
| -61 | —$C_2H_4$— | —$CH_2$— | " | —$C_2H_5$ | " | —$C_2H_5$ | —$CH_3$ | —$CH_3$ |
| -62 | —$CH_2$— | — | $R_{43}$: —$CH_3$ | —$CH_3$ | " | —$CH_3$ | — | — |

TABLE 2-continued

| | | | | | | | | |
|---|---|---|---|---|---|---|---|---|
| | | | others: H | | | | | |
| -63 | " | — | $R_{43}$: —$OCH_3$ others: H | " | " | " | — | — |
| -64 | —$C_2H_4$— | — | $R_{43}$: —$OCH_3$ others: H | " | " | " | — | — |
| -65 | —$C_3H_6$— | — | $R_{43}$: —$OCH_3$ others: H | " | " | —$C_2H_5$ | — | — |
| -66 | " | —$CH_2$— | $R_{43}$: —$OCH_3$ others: H | " | " | " | — | — |
| -67 | —$CH_2$— | " | $R_{43}$: —$CH_3$ others: H | " | " | " | " | " |
| -68 | —$C_2H_4$— | " | $R_{43}$: —$CH_3$ others: H | " | " | " | " | " |

| No. | $R_{63}$–$R_{66}$ | g | h | i | j | k | l |
|---|---|---|---|---|---|---|---|
| (3)-1 | all: H | 0 | 1 | 1 | — | — | — |
| -2 | " | 0 | 1 | 1 | — | — | — |
| -3 | " | 0 | 1 | 1 | — | — | — |
| -4 | " | 0 | 1 | 1 | — | — | — |
| -5 | " | 0 | 1 | 1 | — | — | — |
| -6 | " | 0 | 1 | 1 | — | — | — |
| -7 | " | 0 | 1 | 1 | — | — | — |
| -8 | " | 0 | 1 | 1 | — | — | — |
| -9 | " | 0 | 1 | 1 | — | — | — |
| -10 | " | 0 | 1 | 1 | — | — | — |
| -11 | " | 0 | 1 | 1 | — | — | — |
| -12 | " | 0 | 1 | 1 | — | — | — |
| -21 | " | 1 | 1 | 1 | 1 | 1 | 1 |
| -22 | " | 2 | 1 | 1 | 1 | 1 | 1 |
| -23 | " | 5 | 1 | 1 | 1 | 1 | 1 |
| -24 | " | 10 | 1 | 1 | 1 | 1 | 1 |
| -25 | " | 20 | 1 | 1 | 1 | 1 | 1 |
| -26 | " | 40 | 1 | 1 | 1 | 1 | 1 |
| -27 | " | 80 | 1 | 1 | 1 | 1 | 1 |
| -28 | " | 1 | 1 | 1 | 1 | 1 | 1 |
| -29 | " | 2 | 1 | 1 | 1 | 1 | 1 |
| -30 | " | 10 | 1 | 1 | 1 | 1 | 1 |
| -31 | " | 1 | 1 | 1 | 1 | 1 | 1 |
| -32 | " | 5 | 1 | 1 | 1 | 1 | 1 |
| -33 | " | 1 | 1 | 1 | 1 | 1 | 1 |
| -34 | " | 1 | 1 | 1 | — | — | — |
| -35 | " | 1 | 1 | 1 | — | — | — |
| -36 | " | 1 | 1 | 1 | — | — | — |
| -37 | " | 1 | 1 | 1 | — | — | — |
| -38 | all: H | 1 | 1 | 1 | — | — | — |
| -39 | " | 1 | 1 | 1 | — | — | — |
| -40 | " | 1 | 1 | 1 | — | — | — |
| -41 | " | 1 | 1 | 1 | — | — | — |
| -42 | " | 1 | 1 | 1 | — | — | — |
| -43 | " | 1 | 1 | 1 | — | — | — |
| -44 | " | 1 | 1 | 1 | — | — | — |
| -45 | " | 1 | 1 | 1 | — | — | — |
| -46 | " | 1 | 1 | 1 | — | — | — |
| -47 | " | 1 | 1 | 1 | — | — | — |
| -51 | " | 0 | 2 | 2 | — | — | — |
| -52 | " | 0 | 3 | 3 | — | — | — |
| -53 | " | 0 | 4 | 4 | — | — | — |
| -54 | " | 1 | 2 | 2 | 2 | 2 | 1 |
| -55 | " | 1 | 2 | 2 | 2 | 2 | 1 |
| -56 | " | 10 | 2 | 2 | 2 | 2 | 1 |
| -57 | " | 20 | 2 | 2 | 2 | 2 | 1 |
| -58 | " | 1 | 3 | 3 | 2 | 2 | 1 |
| -59 | " | 1 | 3 | 1 | 3 | 1 | 2 |
| -60 | " | 1 | 4 | 1 | 4 | 1 | 5 |
| -61 | " | 2 | 1 | 1 | 1 | 1 | 10 |
| -62 | $R_{64}$: —$CH_3$ others: H | 0 | 1 | 1 | — | — | — |
| -63 | $R_{64}$: —$OCH_3$ others: H | 0 | 1 | 1 | — | — | — |
| -64 | $R_{64}$: —$OCH_3$ others: H | 0 | 1 | 1 | — | — | — |
| -65 | $R_{64}$: —$OCH_3$ others: H | 0 | 1 | 1 | — | — | — |
| -66 | $R_{64}$: —$OCH_3$ others: H | 1 | 1 | 1 | 1 | 1 | 1 |

TABLE 2-continued
| | | | | | | | |
|---|---|---|---|---|---|---|---|
| -67 | $R_{64}$: —$CH_3$ others: H | 1 | 1 | 1 | 1 | 1 | 1 |
| -68 | $R_{64}$: —$CH_3$ others: H | 1 | 1 | 1 | 1 | 1 | 1 |
Preferred examples of the structural unit represented by Formula (4) are shown below. The present invention is by no means limited to these.
(4)-1
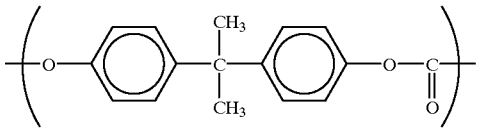
(4)-2
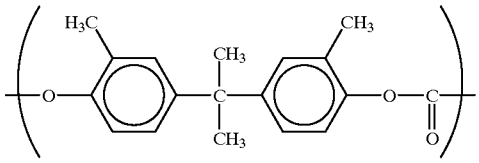
(4)-3
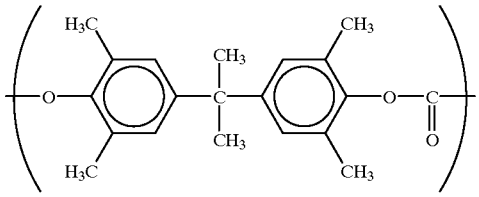
(4)-4
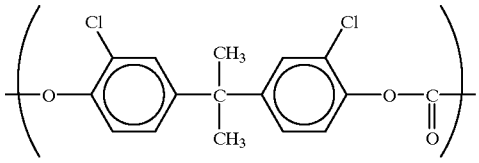
(4)-5
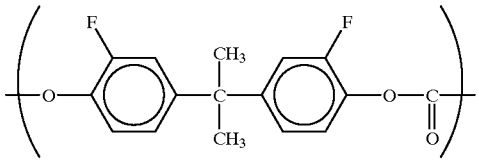
(4)-6
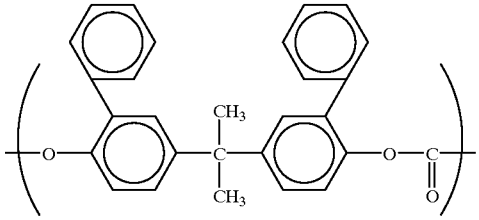
-continued
(4)-7
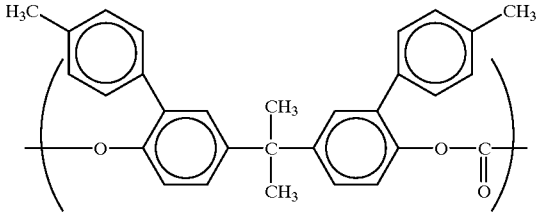
(4)-8
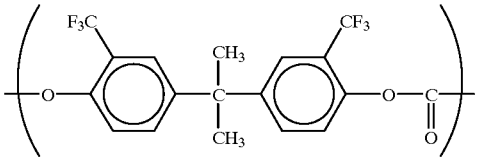
(4)-9
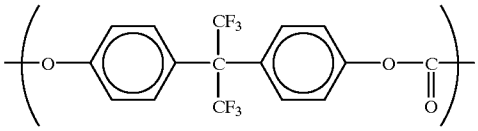
(4)-10
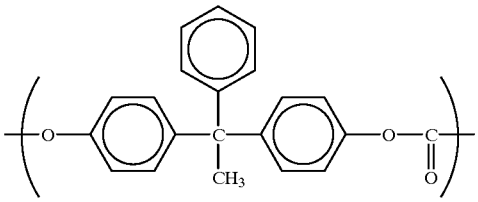
(4)-11
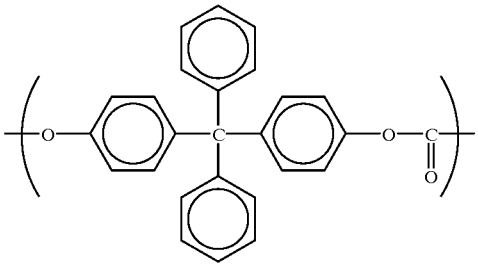

-continued (4)-12

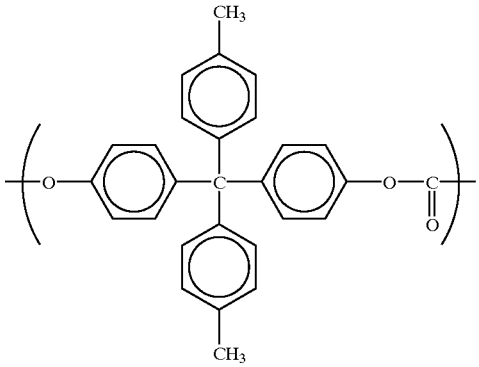

(4)-13

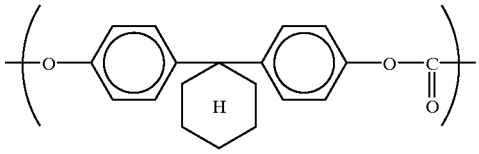

(4)-14

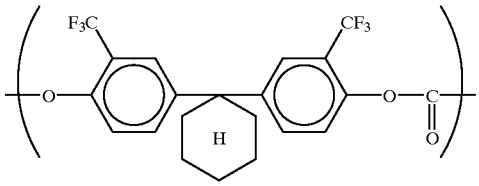

(4)-15

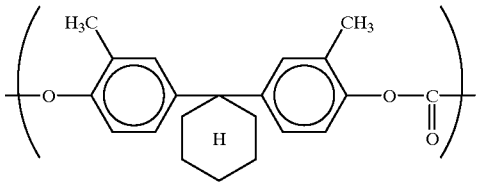

(4)-16

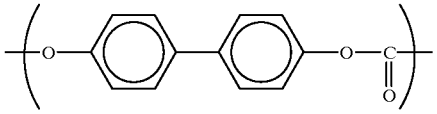

(4)-17

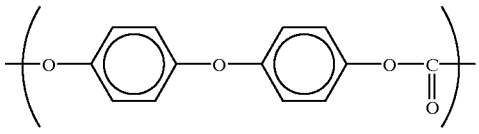

(4)-18

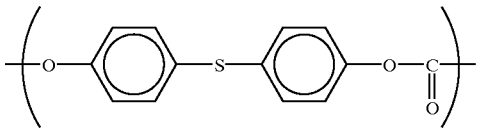

Of these, units (4)-1, (4)-2, (4)-10 and (4)-13 are particularly preferred.

There are no particular limitations on how to synthesize the polyarylate resin used in the present invention. For example, it can be obtained by subjecting as monomers two kinds of bisphenols capable of deriving the structural units of Formulas (1) and (2), to polycondensation with phthalic acid by a conventional method (e.g., interfacial polycondensation).

There are also no particular limitations on how to synthesize the polycarbonate resin used in the present invention. For example, it can be obtained by subjecting as monomers two kinds of bisphenols capable of deriving the structural units of Formulas (3) and (4), to polycondensation with phosgene by a conventional method.

Synthesis Example 1

In 500 ml of an aqueous 10% sodium hydroxide solution, 2.5 g of a siloxane type bisphenol having as a central skeleton the structure represented by the exemplary structural unit (1)-8 and 17.5 g of bisphenol C were added and dissolved. Then, 0.05 g of trimethylbenzylammonium chloride was further added as a polymerization initiator, and the mixture obtained was stirred to obtain a monomer composition. Separately, 4.1 g of an equimolar mixture of terephthalic acid chloride and isophthalic acid chloride was dissolved in 300 ml of dichloromethane solution. This dichloromethane solution was added in the above monomer composition with stirring to initiate polymerization. The reaction mixture was stirred for 3 hours while keeping the reaction temperature at 25° C. or below. Thereafter, acetic acid was added to terminate the reaction, followed by washing repeatedly until the aqueous phase turned neutral. Next, the resultant solution was dropwise added to methanol with stirring to cause a polymer to precipitate. This polymer was vacuum-dried to obtain a polyarylate resin of the present invention, having structural units represented by the exemplary structural units (1)-8 and (2)-2.

Synthesis Example 2

In 500 ml of an aqueous 10% sodium hydroxide solution, 35 g of bisphenol Z was added and dissolved. To the resultant solution, 300 ml of dichloromethane was added and stirred, and 100 g of phosgene was introduced into it in a period of 1 hour while keeping the solution temperature at 10 to 15° C. At the time the phosgene was blown into it by about 70%, 15.0 g of a siloxane type bisphenol having as a central skeleton the structure represented by the exemplary structural unit (3)-1 was added to the solution. After the introduction of phosgene was completed, the reaction mixture was stirred vigorously, and 0.2 ml of triethylamihe was added, followed by stirring for 1 hour. Thereafter, the dichloromethane phase was neutralized with phosphoric acid, further followed by washing with water repeatedly until the reaction mixture had a pH of about 7. Next, the liquid phase thus formed was dropwise added to isopropanol, and the precipitate formed was filtered and then dried to obtain a polycarbonate resin of the present invention, having structural units represented by the exemplary structural units (3)-1 and (4)-13.

The polyarylate resin of the present invention may preferably have a weight-average molecular weight (Mw) of from 10,000 to 200,000, and particularly preferably from 20,000 to 150,000. It may also preferably have a copolymerization ratio of structural units Formulas (2)/(1)=99/1 to 50/50, and particularly preferably from 97/3 to 70/30, as weight ratio. If the unit of Formula (1) is less than 1 in the above ratio, it may be difficult for the resin to exhibit the lubricity and the function to prevent adhesion of toner. If it is more than 50, it may be difficult to achieve a sufficient strength required for the surface layer of the photosensitive member.

The polycarbonate resin of the present invention may also preferably have a viscosity-average molecular weight (Mv) of from 10,000 to 150,000, and particularly preferably from 20,000 to 100,000. It may also preferably have a copolymerization ratio of structural units Formulas (4)/(3)=99/1 to 50/50, and particularly preferably from 97/3 to 70/30, as weight ratio. If the unit of Formula (3) is less than 1 in the above ratio, it may be difficult for the resin to exhibit the lubricity, the solvent cracking resistance and the function to prevent adhesion of toner. If it is more than 50, it may be difficult to achieve a sufficient strength required for the surface layer of the photosensitive member.

The surface layer of the electrophotographic photosensitive member of the present invention is roughly grouped into an instance where it is a photosensitive layer and an instance where it is a protective layer provided on the photosensitive layer.

In the instance where the surface layer is a photosensitive layer and when the photosensitive layer is of a single-layer type in which a charge-generating material and a charge-transporting material are contained in the same layer, that layer is the surface layer. Also, when the photosensitive layer is of a multi-layer type in which a charge transport layer containing a charge-transporting material is provided on a charge generation layer containing a charge-generating material, the charge transport layer is the surface layer, and when conversely the charge generation layer is an upper layer, the charge generation layer is the surface layer.

In the present invention, in view of electrophotographic performance, it is preferred that the charge transport layer is the surface layer.

The charge transport layer can be formed by coating a solution prepared by dissolving a charge-transporting material and a binder resin using a suitable solvent, followed by drying. The charge-transporting material used may include triarylamine compounds, hydrazone compounds, stilbene compounds, pyrazoline compounds, oxazole compounds, triarylmethane compounds and thiazole compounds. The binder resin may include the polyarylate resin and polycarbonate resin of the present invention in the case when the charge transport layer is the surface layer, and other various resins in the case when it is not the surface layer. The charge-transporting material and the binder resin may preferably be used in a weight ratio of from 1:0.5 to 1:2. Also, the charge transport layer may preferably have a layer thickness of from 5 to 40 μm, and particularly preferably from 15 to 30 μm.

The charge generation layer can be formed by coating a dispersion prepared by well dispersing a charge-generating material together with a binder resin used in 0.3- to 4-fold weight and a solvent by means of a homogenizer, an ultrasonic dispersion machine, a ball mill, a vibration ball mill, a sand mill, an attritor, a roll mill or a liquid impact type high-speed dispersion machine, followed by drying. The charge-generating material used in the present invention may include dyes of selenium-tellurium, pyrylium and thiapyrylium types, and pigments of phthalocyanine, anthanthrone, dibenzpyrenequinone, trisazo, cyanine, disazo, monoazo, indigo, quinacridone and unsymmetrical quinocyanine types. The binder resin may include the polyarylate resin and polycarbonate resin of the present invention in the case when the charge generation layer is the surface layer, and other various resins in the case when it is not the surface layer. The charge generation layer may preferably have a layer thickness of 5 μm or smaller, and particularly preferably from 0.1 to 2 μm.

In the case when the photosensitive layer is of the single-layer type, the layer can be formed by coating a solution prepared by dispersing and dissolving in a binder resin the charge-generating material and charge-transporting material as described above, followed by drying. Such a photosensitive layer may preferably have a layer thickness of from 5 to 40 μm, and particularly preferably from 15 to 30 μm.

The protective layer can be formed by coating a solution containing the polyarylate resin or polycarbonate resin of the present invention and optionally an organic or inorganic material resistance control agent, followed by drying. The protective layer may preferably have a layer thickness of from 0.5 to 10 μm, and preferably from 1 to 5 μm.

In the present invention, an antioxidant and a lubricant may also be added to the surface layer.

The support used in the present invention may be any of those having a conductivity. It may be made of a material including metals such as aluminum and stainless steel, and metals, papers or plastics provided with conductive layers, and may have a form of a sheet or a cylinder.

In the present invention, for the purposes of preventing interference fringes and covering scratches of the support, a conductive layer may also be provided between the support and the photosensitive layer. Such a conductive layer can be formed by coating a dispersion prepared by dispersing a conductive powder such as carbon black, metal particles or metal oxide particles in a binder resin, followed by drying. The conductive layer may preferably have a layer thickness of from 5 to 40 μm, and particularly preferably from 10 to 30 μm.

In the present invention, an intermediate layer having the function of adhesion and the function as a barrier may optionally be provided between the support and the photosensitive layer or between the conductive layer and the photosensitive layer. Materials for the intermediate layer may include polyamide, polyvinyl alcohol, polyethylene oxide, ethyl cellulose, casein, polyurethane and polyetherurethane. The intermediate layer can be formed by coating a solution prepared by dissolving any of these materials in a suitable solvent, followed by drying. It may preferably have a layer thickness of from 0.05 to 5 μm, and particularly preferably from 0.3 to 1 μm.

The Figure schematically illustrates the construction of an electrophotographic apparatus having a process cartridge having the electrophotographic photosensitive member of the present invention.

In the Figure, reference numeral 1 denotes a drum type electrophotographic photosensitive member of the present invention, which is rotatingly driven around an axis 2 in the direction of an arrow at a given peripheral speed. The photosensitive member 1 is uniformly electrostatically charged on its periphery to a positive or negative, given potential through a primary charging means 3. The photosensitive member thus charged is then photo imagewise exposed to light 4 emitted from an imagewise exposure means (not shown) for slit exposure or laser beam scanning exposure. In this way, electrostatic latent images are successively formed on the periphery of the photosensitive member 1.

The electrostatic latent images thus formed are subsequently developed by toner by the operation of a developing means 5. The toner-developed images formed by development are then successively transferred by the operation of a transfer means 6, to the surface of a transfer medium 7 fed from a paper feed section (not shown) to the part between the photosensitive member 1 and the transfer means 6 in the manner synchronized with the rotation of the photosensitive member 1.

The transfer medium 7 on which the images have been transferred is separated from the surface of the photosensitive member, is led through an image fixing means 8, where the images are fixed, and is then printed out of the apparatus as a copied material (a copy).

The surface of the photosensitive member 1 from which images have been transferred is brought to removal of the toner remaining after the transfer, through a cleaning means 9. Thus the photosensitive member is cleaned on its surface, further subjected to charge-elimination by pre-exposure light 10 emitted from a pre-exposure means (not shown), and then repeatedly used for the formation of images. When the primary charging means 3 is a contact charging means making use of a charging roller, the pre-exposure is not necessarily required.

In the present invention, the apparatus may be constituted of a combination of plural components integrally joined as a process cartridge from among the constituents such as the above electrophotographic photosensitive member 1, primary charging means 3, developing means 5 and cleaning means 9 so that the process cartridge is detachable from the body of the electrophotographic apparatus such as a copying machine or a laser beam printer. For example, at least one of the primary charging means 3, the developing means 5 and the cleaning means 9 may be integrally supported in a cartridge together with the photosensitive member 1 to form a process cartridge 11 that is detachable from the body of the apparatus through a guide means such as a rail 12 provided in the body of the apparatus.

In the case when the electrophotographic apparatus is a copying machine or a printer, the light 4 of imagewise exposure is light reflected from, or transmitted through, an original, or light irradiated by the scanning of a laser beam, the driving of an LED array or the driving of a liquid crystal shutter array according to signals obtained by reading an original through a sensor and converting the information into signals.

The electrophotographic photosensitive member of the present invention may be not only utilized in electrophotographic copying machines, but also widely used in the fields where electrophotography is applied, e.g., laser beam printers, CRT printers, LED printers, liquid-crystal printers and laser beam engravers.

The present invention will be described below in greater detail by giving Examples. In the following Examples, "part(s)" refers to "part(s) by weight".

EXAMPLE 1

On an aluminum cylinder of 30 mm diameter and 357 mm long, a coating fluid comprised of the following materials was coated by dip coating, followed by heat-curing at 140° C. for 30 minutes to form a conductive layer with a layer thickness of 15 μm.

| | |
|---|---|
| Conductive pigment: $SnO_2$-coated barium sulfate | 10 parts |
| Resistance modifying pigment: Titanium oxide | 2 parts |
| Binder resin: Phenol resin | 6 parts |
| Leveling material: Silicone oil | 0.001 part |
| Solvent: Methanol/methoxypropanol (0.2/0.8) | 20 parts |

Next, on this conductive layer, a solution prepared by dissolving 3 parts of N-methoxymethylated nylon and 3 parts of copolymer nylon in a mixed solvent of 65 parts of methanol and 30 parts of n-butanol was coated, followed by drying to form an intermediate layer with a layer thickness of 0.5 μm.

Next, a solution prepared by mixing 4 parts of oxytitanium phthalocyanine having strong peaks at BraggüLs angles 2θ plus-minus 0.2° of 9.0°, 14.2°, 23.90° and 27.1° as measured by CuKa characteristic X-ray diffraction, 2 parts of polyvinyl butyral (trade name: S-LEC BM2; available from Sekisui Chemical Co., Ltd.) and 60 parts of cyclohexanone was dispersed for 4 hours by means of a sand grinder making use of glass beads of 1 mm diameter, followed by addition of 100 parts of ethyl acetate to obtain a charge generation layer forming dispersion. This dispersion was coated on the intermediate layer by dip coating, followed by drying to form a charge generation layer with a layer thickness of 0.3 μm.

Next, in order to form a charge transport layer, a charge transport layer forming coating solution was prepared.

In a mixed solvent of 50 parts of monochlorobenzene and 50 parts of dichloromethane, 5 parts of a copolymer (weight-average molecular weight Mw: about 60,000) comprised of the exemplary structural units Formulas (2)-1/(1)-28=80/20 (weight ratio), 5 parts of polyarylate resin (U-100, available from Unichika, Ltd.) and 9 parts of a triarylamine represented by the formula:

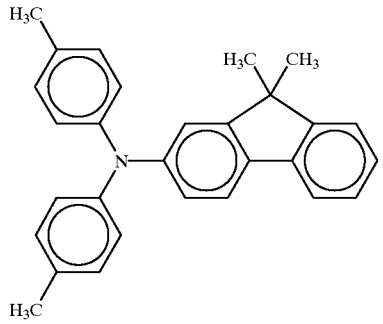

and 1 part of a styryl compound represented by the formula:

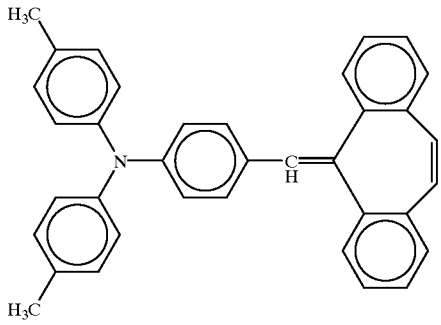

were dissolved. The resultant solution was coated on the charge generation layer by dip coating, followed by drying at 120° C. for 1 hour to form a charge transport layer with a layer thickness of 20 μm.

On the electrophotographic photosensitive member thus produced, evaluation was made in the following way.

This photosensitive member was set in a copying machine GP-215 (using the roller contact charging system), manufactured by CANON INC. A running test to reproduce images on 20,000 A4-size sheets was made in an environment of 30° C. and 85% RH and in an intermittent mode where copying was stopped once for each sheet. The depth of wear of the surface layer was measured and also image quality was evaluated by visual observation. To measure the depth of wear, an eddy-current layer thickness measuring device (PERMASCOPE Type-E111) manufactured by Fischer Co. was used.

To examine the solvent cracking resistance, sebum was made to adhere to the surface of the photosensitive member, which was then left for 72 hours, and thereafter microscopic observation was made to examine whether or not solvent cracking occurred.

The results are shown in Table 3.

EXAMPLES 2 to 11

Photosensitive members were produced in the same manner as in Example 1 except that the binder resin for the charge transport layer was replaced with those shown in Table 3. Evaluation was made similarly.

The results are shown in Table 3.

COMPARATIVE EXAMPLE 1

A photosensitive member was produced in the same manner as in Example 1 except that the binder resin for the charge transport layer was replaced with bisphenol A type polyarylate resin (Mw: about 60,000; U-100, available from Unichika, Ltd.) having only the structural unit of Formula (2)-1. Evaluation was made similarly.

The results are shown in Table 3.

COMPARATIVE EXAMPLE 2

A photosensitive member was produced in the same manner as in Example 1 except that the binder resin for the charge transport layer was replaced with a compound represented by the following formula (A). Evaluation was made similarly.

The results are shown in Table 3.

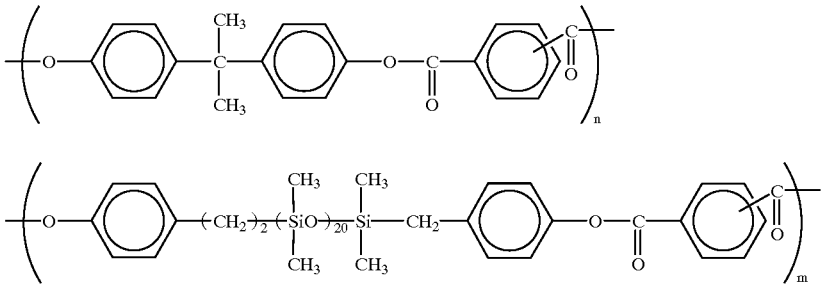

(A)

Mw: 80,000; n/m: 80/20

TABLE 3

| Copolymer structural units Formulas (2)/(1) | Depth of wear (μm) | Image quality | Solvent cracking |
|---|---|---|---|
| Example: | | | |
| 1 (2) – 1/(1) – 28 | 4.8 | Good | None |
| 2 (2) – 2/(1) – 30 | 4.7 | Good | None |
| 3 (2) – 10/(1) – 35 | 4.6 | Good | None |

TABLE 3-continued

| Copolymer structural units Formulas (2)/(1) | Depth of wear (μm) | Image quality | Solvent cracking |
|---|---|---|---|
| 4 (2) – 11/(1) – 39 | 4.7 | Good | None |
| 5 (2) – 16/(1) – 45 | 4.5 | Good | None |
| 6 (2) – 1/(1) – 51 | 4.7 | Good | None |
| 7 (2) – 1/(1) – 53 | 4.8 | Good | None |
| 8 (2) – 1/(1) – 57 | 5.0 | Good | None |
| 9 (2) – 1/(1) – 59 | 4.9 | Good | None |
| 10 (2) – 1/(1) – 61 | 5.0 | Good | None |
| 11 (2) – 2/(1) – 66 | 4.8 | Good | None |
| Comparative Example: | | | |
| 1 Bisphenol A polyarylate resin | 5.2 | Frictional sound between photosensitive member and blade | Occur |
| 2 Formula (A) | 6.1 | Fogging | None |

EXAMPLE 12

A photosensitive member was produced in the same manner as in Example 1 except that the binder resin for the charge transport layer was replaced with 10 parts of a copolymer comprised of the exemplary structural units Formulas (2)-1/(1)-1=90/10 (weight ratio). Evaluation was made similarly. The photosensitive member was set also in a copying machine GP-55 (a corona charging system), manufactured by Canon Kabushiki Kaisha to make running tests similarly.

The results are shown in Table 4.

EXAMPLES 13 to 17

Photosensitive members were produced in the same manner as in Example 12 except that the binder resin for the charge transport layer was replaced with those shown in Table 4. Evaluation was made similarly.

The results are shown in Table 4.

COMPARATIVE EXAMPLES 3 and 4

Evaluation was made on the photosensitive members obtained in Comparative Examples 1 and 2, respectively, in the same manner as in Example 12.

The results are shown in Table 4.

TABLE 4

| Copolymer structural units Formulas (2)/(1) | GP-215 Depth of wear (μm) | GP-215 Image quality | GP-55 Depth of wear (μm) | GP-55 Image quality | Solvent cracking |
|---|---|---|---|---|---|
| Example: | | | | | |
| 12 (2)-1/(1)-1 | 4.5 | Good | 3.8 | Good | None |
| 13 (2)-2/(1)-1 | 4.5 | Good | 3.8 | Good | None |
| 14 (2)-2/(1)-4 | 4.4 | Good | 3.6 | Good | None |
| 15 (2)-2/(1)-8 | 4.3 | Good | 3.6 | Good | None |
| 16 (2)-2/(1)-12 | 4.4 | Good | 3.6 | Good | None |
| 17 (2)-2/(1)-65 | 4.4 | Good | 3.6 | Good | None |
| Comparative Example: | | | | | |
| 3 Bisphenol A polyarylate resin | 5.2 | Blade turn = over, Toner adhe-sion | 4.0 | Blade turn = over, Scratch-ing | Occur |
| 4 Formula (A) | 6.1 | Fogging | 5.8 | Fogging | None |

EXAMPLE 18

On an aluminum cylinder of 30 mm diameter and 254 mm long, a coating fluid comprised of the following materials was coated by dip coating, followed by heat-curing at 140° C. for 30 minutes to form a conductive layer with a layer thickness of 15 μm.

| | |
|---|---|
| Conductive pigment: $SnO_2$-coated barium sulfate | 10 parts |
| Resistance modifying pigment: Titanium oxide | 2 parts |
| Binder resin: Phenol resin | 6 parts |
| Leveling material: Silicone oil | 0.001 part |
| Solvent: Methanol/methoxypropanol (0.2/0.8) | 20 parts |

Next, on this conductive layer, a solution prepared by dissolving 3 parts of N-methoxymethylated nylon and 3 parts of copolymer nylon in a mixed solvent of 65 parts of methanol and 30 parts of n-butanol was coated, followed by drying to form an intermediate layer with a layer thickness of 0.5 μm.

Next, a solution prepared by mixing 4 parts of oxytitanium phthalocyanine having strong peaks at BraggüLs angles 2θ plus-minus 0.2° of 9.0°, 14.2°, 23.9° and 27.1° as measured by CuKα characteristic X-ray diffraction, 2 parts of polyvinyl butyral (trade name: S-LEC BM2; available from Sekisui Chemical Co., Ltd.) and 60 parts of cyclohexanone was dispersed for 4 hours by means of a sand grinder making use of glass beads of 1 mm diameter, followed by addition of 100 parts of ethyl acetate to obtain a charge generation layer forming dispersion. This dispersion was coated on the intermediate layer by dip coating, followed by drying to form a charge generation layer with a layer thickness of 0.3 μm.

Next, in order to form a charge transport layer, a charge transport layer forming coating solution was prepared.

In a mixed solvent of 50 parts of monochlorobenzene and 50 parts of dichloromethane, 10 parts of a copolymer (viscosity-average molecular weight Mv: about 40,000) comprised of the exemplary structural units Formulas (4)-13/(3)-1=90/10 (weight ratio), 9 parts of a triarylamine represented by the formula:

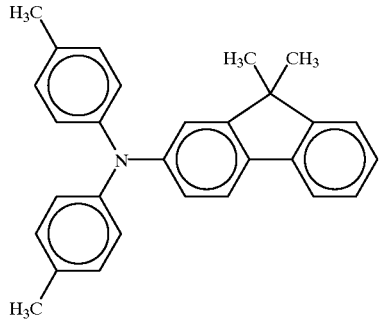

and 1 part of a styryl compound represented by the formula:

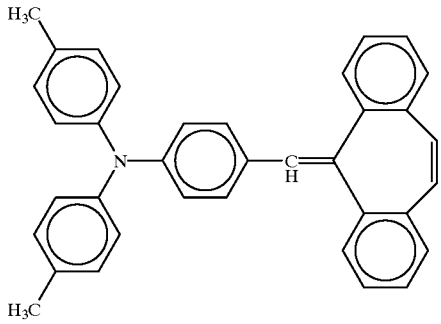

were dissolved. The resultant solution was coated on the charge generation layer by dip coating, followed by drying at 120° C. for 1 hour to form a charge transport layer with a layer thickness of 23 μm.

On the electrophotographic photosensitive member thus produced, evaluation was made in the following way.

This photosensitive member was set in a laser beam printer LASER JET 4 PLUS, manufactured by Hullet Packard Co., having a roller contact charging means. A running test to reproduce images on 3,000 A4-size sheets was made in an environment of 30° C. and 85% RH and in an intermittent mode where copying was stopped once for each sheet. The depth of wear of the surface layer was measured and also image quality was evaluated by visual observation. To measure the depth of wear, an eddy-current layer thickness measuring device (PERMASCOPE Type-E111) manufactured by Fischer Co. was used.

To examine the solvent cracking resistance, sebum was made to adhere to the surface of the photosensitive member, which was then left for 36 hours, and thereafter microscopic observation was made to examine whether or not solvent cracking occurred.

The results are shown in Table 5.

EXAMPLES 19 to 28

Photosensitive members were produced in the same manner as in Example 18 except that the binder resin for the charge transport layer was replaced with those shown in Table 5. Evaluation was made similarly.

The results are shown in Table 5.

COMPARATIVE EXAMPLE 5

A photosensitive member was produced in the same manner as in Example 18 except that the binder resin for the charge transport layer was replaced with bisphenol Z type polycarbonate resin (Mv: 40,000; IUPILON, available from Mitsubishi Gas Chemical Company, Inc.) having only the structural unit of Formula (4)-13. Evaluation was made similarly.

The results are shown in Table 5.

COMPARATIVE EXAMPLE 6

A photosensitive member was produced in the same manner as in Example 18 except that the binder resin for the charge transport layer was replaced with a compound represented by the following formula (B). Evaluation was made similarly.

The results are shown in Table 5.

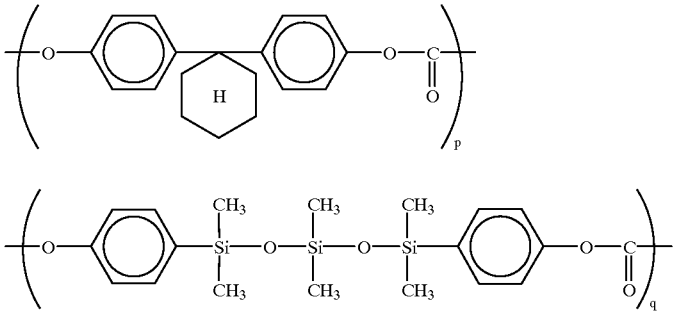

(B)

Mv: 40,000; p/q: 80/20 (weight ratio)

TABLE 5

| Copolymer structural units Formulas (4)/(3) | Depth of wear (μm) | Image quality | Solvent cracking |
|---|---|---|---|
| Example: | | | |
| 18 (4) – 13/(3) – 1 | 4.5 | Good | None |
| 19 (4) – 13/(3) – 3 | 4.5 | Good | None |
| 20 (4) – 13/(3) – 5 | 4.6 | Good | None |
| 21 (4) – 13/(3) – 8 | 4.4 | Good | None |
| 22 (4) – 13/(3) – 10 | 4.5 | Good | None |
| 23 (4) – 1/(3) – 21 | 4.7 | Good | None |
| 24 (4) – 1/(3) – 24 | 4.8 | Good | None |
| 25 (4) – 1/(3) – 36 | 4.8 | Good | None |
| 26 (4) – 2/(3) – 51 | 4.8 | Good | None |
| 27 (4) – 2/(3) – 59 | 4.8 | Good | None |
| 28 (4) – 2/(3) – 65 | 4.6 | Good | None |
| Comparative Example: | | | |
| 5 Bisphenol Z polycarbonate resin | 4.5 | Blade turn-over, Scratching | Occur |
| 6 Formula (B) | 5.8 | Fogging | None |

EXAMPLE 29

A photosensitive member was produced in the same manner as in Example 18 except that the binder resin for the charge transport layer was replaced with a mixture of 5 parts of a copolymer comprised of the exemplary structural units Formulas (4)-1/(3)-28=70/30 (weight ratio) and 5 parts of bisphenol Z type polycarbonate resin. Evaluation was made similarly.

The results are shown in Table 6.

EXAMPLES 30 to 36

Photosensitive members were produced in the same manner as in Example 29 except that the binder resin for the charge transport layer was replaced with those shown in Table 6. Evaluation was made similarly.

The results are shown in Table 6.

TABLE 6

| Copolymer structural units Formulas (4)/(3) | Depth of wear (μm) | Image quality | Solvent cracking |
|---|---|---|---|
| Example: | | | |
| 29 (4)-1/(3)-28 | 4.4 | Good | None |
| 30 (4)-2/(3)-29 | 4.2 | Good | None |
| 31 (4)-10/(3)-35 | 4.2 | Good | None |
| 32 (4)-13/(3)-39 | 4.3 | Good | None |
| 33 (4)-17/(3)-43 | 4.5 | Good | None |
| 34 (4)-13/(3)-52 | 4.5 | Good | None |
| 35 (4)-13/(3)-60 | 4.5 | Good | None |
| 36 (4)-13/(3)-65 | 4.3 | Good | None |

What is claimed is:

1. An electrophotographic photosensitive member comprising a conductive support and a photosensitive layer provided on the conductive support;

said electrophotographic photosensitive member having a surface layer which contains a polyarylate resin or polycarbonate resin having a structural unit having a cyclic siloxane structure in its backbone chain.

2. The electrophotographic photosensitive member according to claim 1, wherein said surface layer contains the polyarylate resin.

3. The electrophotographic photosensitive member according to claim 2, wherein the structural unit having a cyclic siloxane structure of said polyarylate resin is represented by the following Formula (1)

(1)

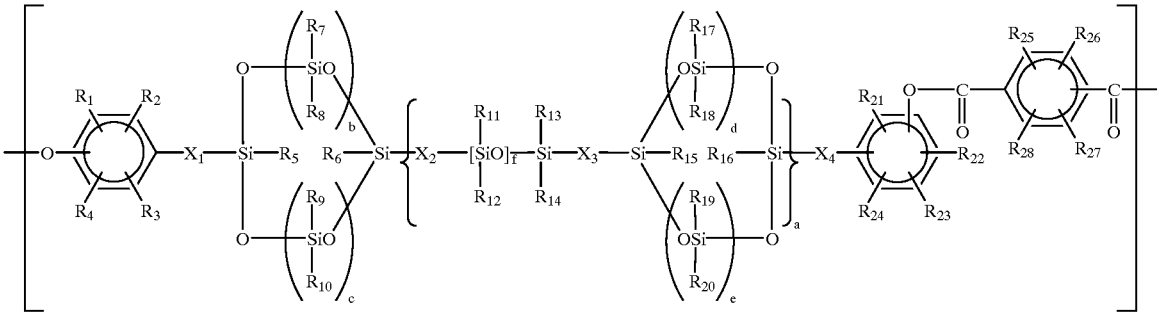

wherein $R_1$ to $R_4$ and $R_{21}$ to $R_{28}$ are the same or different and each represent a hydrogen atom, a halogen atom, a substituted or unsubstituted alkyl group, a substituted or unsubstituted alkoxyl group or a substituted or unsubstituted aryl group; $R_5$ to $R_{20}$ are the same or different and each represent a hydrogen atom, a halogen atom, a substituted or unsubstituted alkyl group or a substituted or unsubstituted aryl group; $X_1$ to $X_4$ are the same or different and each represent a substituted or unsubstituted alkylene group; a represents an integer of 0 to 100; b, c, d and e are the same or different and each represent an integer which is 0 to 10 and wherein $b+c \geqq 2$ and $d+e \geqq 2$; and f represents an integer of 0 to 10.

4. The electrophotographic photosensitive member according to claim 3, wherein said polyarylate resin further has a structural unit represented by the following Formula (2)

(2)

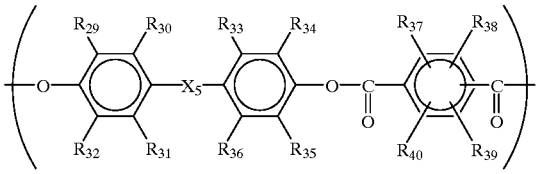

wherein $R_{29}$ to $R_{40}$ are the same or different and each represent a hydrogen atom, a halogen atom, a substituted or unsubstituted alkyl group or a substituted or unsubstituted aryl group; $X_5$ represents a single bond, —O—, —S— or a group represented by the following formula:

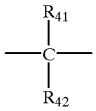

wherein $R_{41}$ and $R_{42}$ are the same or different and each represent a hydrogen atom, a halogen atom, a substituted or unsubstituted alkyl group or a substituted or unsubstituted aryl group; or $R_{41}$ and $R_{42}$ are joined together to form a substituted or unsubstituted cycloalkylidene group together with the intervening carbon atom.

5. The electrophotographic photosensitive member according to claim 4, wherein $R_1$ to $R_4$, $R_{21}$ to $R_{28}$, $R_{30}$, $R_{31}$, $R_{33}$, $R_{36}$ to $R_{39}$ and $R_{40}$ are all hydrogen atoms.

6. The electrophotographic photosensitive member according to claim 1, wherein said surface layer contains the polycarbonate resin.

7. The electrophotographic photosensitive member according to claim 6, wherein the structural unit having a cyclic siloxane structure of said polycarbonate resin is represented by the following Formula (3)

(3)

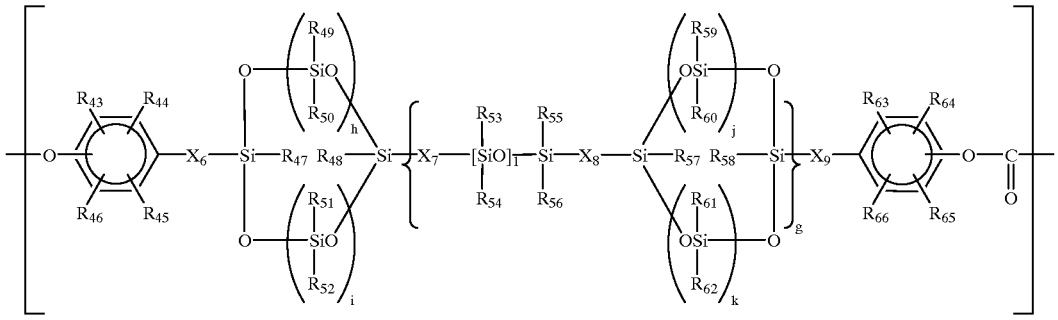

wherein $R_{43}$ to $R_{46}$ and $R_{63}$ to $R_{66}$ are the same or different and each represent a hydrogen atom, a halogen atom, a substituted or unsubstituted alkyl group, a substituted or unsubstituted alkoxyl group or a substituted or unsubstituted aryl group; $R_{47}$ to $R_{62}$ are the same or different and each represent a hydrogen atom, a halogen atom, a substituted or unsubstituted alkyl group or a substituted or unsubstituted aryl group; $X_6$ to $X_9$ are the same or different and each represent a substituted or unsubstituted alkylene group; g represents an integer of 0 to 100; h, i, j and k are the same or different and each represent an integer which is 0 to 10 and wherein $h+i \geqq 2$ and $j+k \geqq 2$; and represents an integer of 0 to 10.

8. The electrophotographic photosensitive member according to claim 7, wherein said polycarbonate resin further has a structural unit represented by the following Formula (4)

(4)

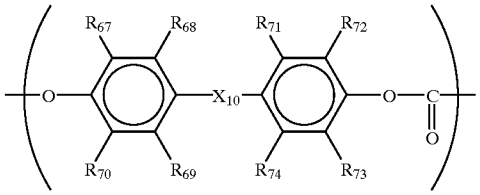

wherein $R_{67}$ to $R_{74}$ are the same or different and each represent a hydrogen atom, a halogen atom, a substituted or unsubstituted alkyl group or a substituted or unsubstituted aryl group; $X_{10}$ represents a single bond, —O—, —S— or a group represented by the following formula:

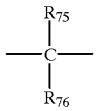

wherein $R_{75}$. and $R_{76}$ are the same or different and each represent a hydrogen atom, a halogen atom, a substituted or unsubstituted alkyl group or a substituted or unsubstituted aryl group; or $R_{75}$ and $R_{76}$ are joined together to form a substituted or unsubstituted cycloalkylidene group together with the intervening carbon atom.

9. The electrophotographic photosensitive member according to claim 8, wherein $R_{43}$ to $R_{46}$, $R_{63}$ to $R_{66}$, $R_{68}$, $R_{69}$, $R_{71}$ and $R_{74}$ are all hydrogen atoms.

10. A process cartridge comprising an electrophotographic photosensitive member and at least one means selected from the group consisting of a charging means, a developing means and a cleaning means;

said electrophotographic photosensitive member and said at least one means being supported as one unit and being detachably mountable to the main body of an electrophotographic apparatus; and said electrophotographic photosensitive member comprising a conductive support and a photosensitive layer provided on the conductive support;

said electrophotographic photosensitive member having a surface layer which contains a polyarylate resin or polycarbonate resin having a structural unit having a cyclic siloxane structure in its backbone chain.

11. The process cartridge according to claim 10, wherein said surface layer of the electrophotographic photosensitive member contains the polyarylate resin.

12. The process cartridge according to claim 11, wherein the structural unit having a cyclic siloxane structure of said polyarylate resin is represented by the following Formula (1)

(1)

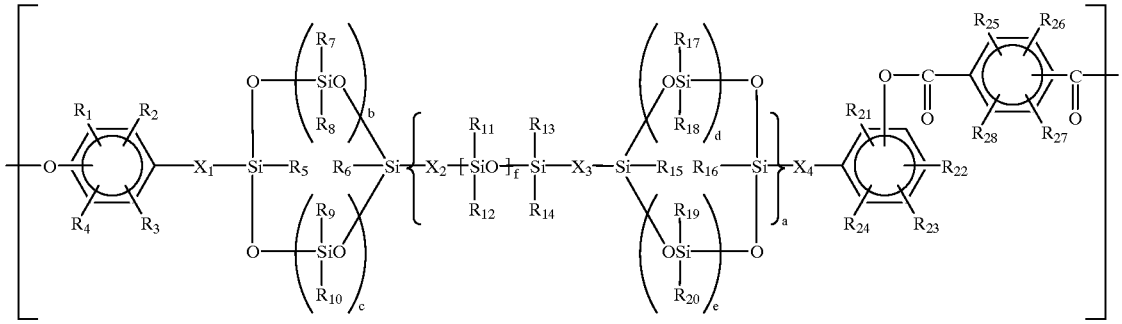

wherein $R_1$ to $R_4$ and $R_{21}$ to $R_{28}$ are the same or different and each represent a hydrogen atom, a halogen atom, a substituted or unsubstituted alkyl group, a substituted or unsubstituted alkoxyl group or a substituted or unsubstituted aryl group; $R_5$ to $R_{20}$ are the same or different and each represent a hydrogen atom, a halogen atom, a substituted or unsubstituted alkyl group or a substituted or unsubstituted aryl group; $X_1$ to $X_4$ are the same or different and each represent a substituted or unsubstituted alkylene group; a represents an integer of 0 to 100; b, c, d and e are the same or different and each represent an integer which is 0 to 10 and wherein $b+c \geqq 2$ and $d+e \geqq 2$; and f represents an integer of 0 to 10.

13. The process cartridge according to claim 12, wherein said polyarylate resin further has a structural unit represented by the following Formula (2)

(2)

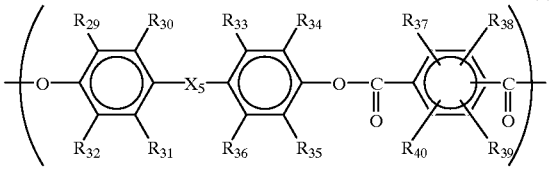

wherein $R_{29}$ to $R_{40}$ are the same or different and each represent a hydrogen atom, a halogen atom, a substituted or unsubstituted alkyl group or a substituted or unsubstituted aryl group; $X_5$ represents a single bond, —O—, —S— or a group represented by the following formula:

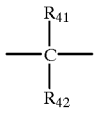

wherein $R_{41}$ and $R_{42}$ are the same or different and each represent a hydrogen atom, a halogen atom, a substituted or unsubstituted alkyl group or a substituted or unsubstituted aryl group; or $R_{41}$ and $R_{42}$ are joined together to form a substituted or unsubstituted cycloalkylidene group together with the intervening carbon atom.

14. The process cartridge according to claim 13, wherein $R_1$ to $R_4$, $R_{21}$ to $R_{28}$, $R_{30}$, $R_{31}$, $R_{33}$, $R_{36}$ to $R_{39}$ and $R_{40}$ are all hydrogen atoms.

15. The process cartridge according to claim 10, wherein said surface layer of the electrophotographic photosensitive member contains the polycarbonate resin.

16. The process cartridge according to claim 15, wherein the structural unit having a cyclic siloxane structure of said polycarbonate resin is represented by the following Formula (3)

(3)

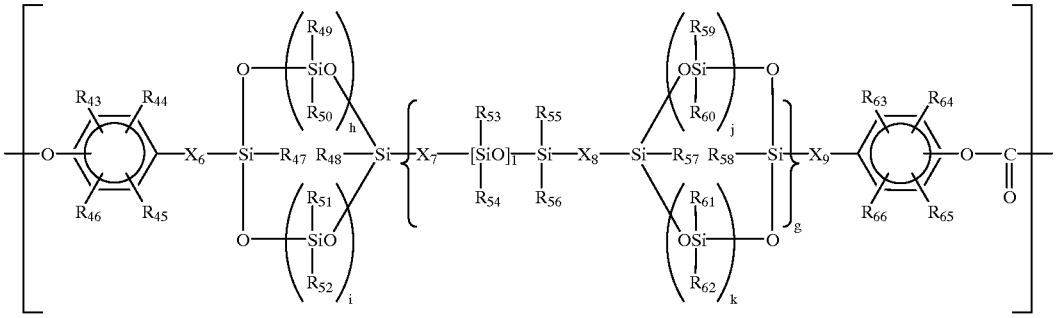

wherein $R_{43}$ to $R_{46}$ and $R_{63}$ to $R_{66}$ are the same or different and each represent a hydrogen atom, a halogen atom, a substituted or unsubstituted alkyl group, a substituted or unsubstituted alkoxyl group or a substituted or unsubstituted aryl group; $R_{47}$ to $R_{62}$ are the same or different and each represent a hydrogen atom, a halogen atom, a substituted or unsubstituted alkyl group or a substituted or unsubstituted aryl group; $X_6$ to $X_9$ are the same or different and each represent a substituted or unsubstituted alkylene group; g represents an integer of 0 to 100; h, i, j and k are the same or different and each represent an integer which is 0 to 10 and wherein $h+i \geqq 2$ and $j+k \geqq 2$; and l represents an integer of 0 to 10.

17. The process cartridge according to claim 16, wherein said polycarbonate resin further has a structural unit represented by the following Formula (4)

(4)

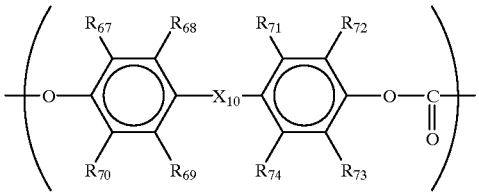

wherein $R_{67}$ to $R_{74}$ are the same or different and each represent a hydrogen atom, a halogen atom, a substituted or unsubstituted alkyl group or a substituted or unsubstituted aryl group; $X_{10}$ represents a single bond, —O—, —S— or a group represented by the following formula:

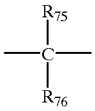

wherein $R_{75}$and $R_{76}$ are the same or different and each represent a hydrogen atom, a halogen atom, a substituted or unsubstituted alkyl group or a substituted or unsubstituted aryl group; or $R_{75}$ and $R_{76}$ are joined together to form a substituted or unsubstituted cycloalkylidene group together with the intervening carbon atom.

18. The process cartridge according to claim 17, wherein $R_{43}$ to $R_{46}$, $R_{63}$ to $R_{66}$, $R_{68}$, $R_{69}$, $R_{71}$ and $R_{74}$ are all hydrogen atoms.

19. An electrophotographic apparatus comprising an electrophotographic photosensitive member, a charging means, an exposure means, a developing means and a transfer means;

said electrophotographic photosensitive member comprising a conductive support and a photosensitive layer provided on the conductive support;

said electrophotographic photosensitive member having a surface layer which contains a polyarylate resin or polycarbonate resin having a structural unit having a cyclic siloxane structure in its backbone chain.

20. The electrophotographic apparatus according to claim 19, wherein said surface layer of the electrophotographic photosensitive member contains the polyarylate resin.

21. The electrophotographic apparatus according to claim 20, wherein the structural unit having a cyclic siloxane structure of said polyarylate resin is represented by the following Formula (1)

(1)

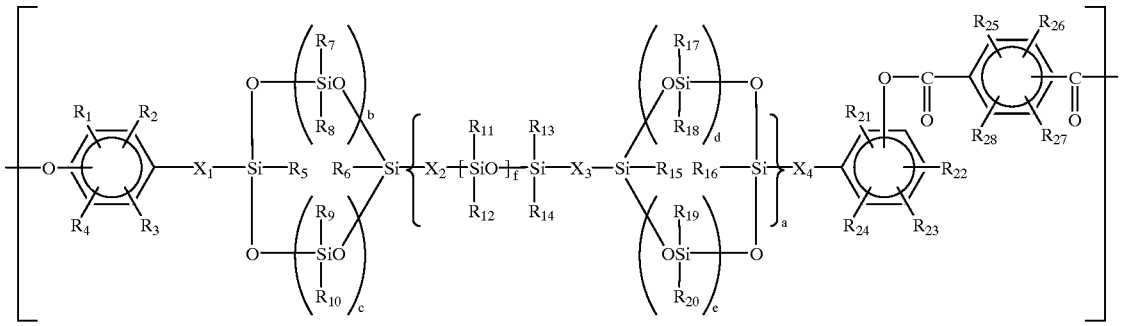

wherein $R_1$ to $R_4$ and $R_{21}$ to $R_{28}$ are the same or different and each represent a hydrogen atom, a halogen atom, a substituted or unsubstituted alkyl group, a substituted or unsubstituted alkoxyl group or a substituted or unsubstituted aryl group; $R_5$ to $R_{20}$ are the same or different and each represent a hydrogen atom, a halogen atom, a substituted or unsubstituted alkyl group or a substituted or unsubstituted aryl group; $X_1$ to $X_4$ are the same or different and each represent a substituted or unsubstituted alkylene group; a represents an integer of 0 to 100; b, c, d and e are the same or different and each represent an integer which is 0 to 10 and wherein b+c≧2 and d+e≧2; and f represents an integer of 0 to 10.

22. The electrophotographic apparatus according to claim 21, wherein said polyarylate resin further has a structural unit represented by the following Formula (2)

(2)

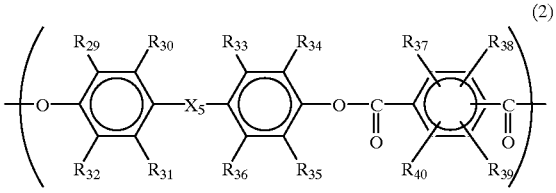

wherein $R_{29}$ to $R_{40}$ are the same or different and each represent a hydrogen atom, a halogen atom, a substituted or unsubstituted alkyl group or a substituted or unsubstituted aryl group; $X_5$ represents a single bond, —O—, —S— or a group represented by the following formula:

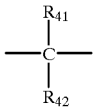

wherein $R_{41}$ and $R_{42}$ are the same or different and each represent a hydrogen atom, a halogen atom, a substituted or unsubstituted alkyl group or a substituted or unsubstituted aryl group; or $R_{41}$ and $R_{42}$ are joined together to form a substituted or unsubstituted cycloalkylidene group together with the intervening carbon atom.

23. The electrophotographic apparatus according to claim 22, wherein $R_1$ to $R_4$, $R_{21}$ to $R_{28}$, $R_{30}$, $R_{31}$, $R_{33}$, $R_{36}$ to $R_{39}$ and $R_{40}$ are all hydrogen atoms.

24. The electrophotographic apparatus according to claim 19, wherein said surface layer of the electrophotographic photosensitive member contains the polycarbonate resin.

25. The electrophotographic apparatus according to claim 24, wherein the structural unit having a cyclic siloxane structure of said polycarbonate resin is represented by the following Formula (3)

(3)

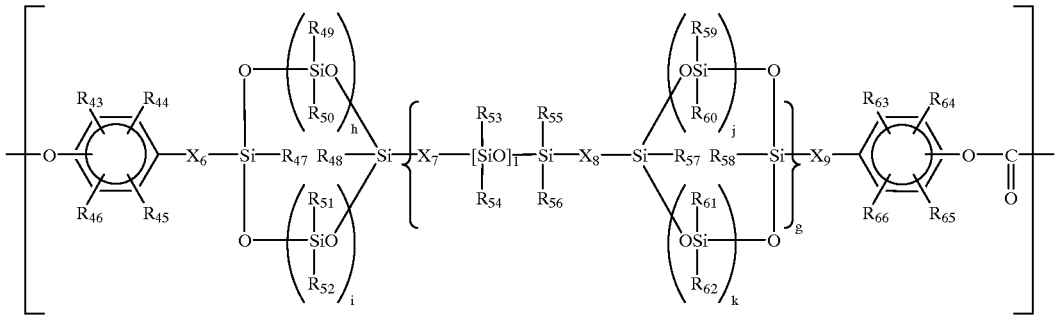

wherein $R_{43}$ to $R_{46}$ and $R_{63}$ to $R_{66}$ are the same or different and each represent a hydrogen atom, a halogen atom, a substituted or unsubstituted alkyl group, a substituted or unsubstituted alkoxyl group or a substituted or unsubstituted aryl group; $R_{47}$ to $R_{62}$ are the same or different and each represent a hydrogen atom, a halogen atom, a substituted or unsubstituted alkyl group or a substituted or unsubstituted aryl group; $X_6$ to $X_9$ are the same or different and each represent a substituted or unsubstituted alkylene group; g represents an integer of 0 to 100; h, i, j and k are the same or different and each represent an integer which is 0 to 10 and werein $h+i \geqq 2$ and $j+k \geqq 2$; and l represents an integer of 0 to 10.

26. The electrophotographic apparatus according to claim 25, wherein said polycarbonate resin further has a structural unit represented by the following Formula (4)

(4)

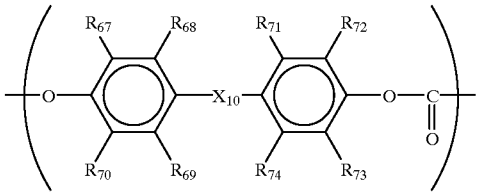

wherein $R_{67}$ to $R_{74}$ are the same or different and each represent a hydrogen atom, a halogen atom, a substituted or unsubstituted alkyl group or a substituted or unsubstituted aryl group; $X_{10}$ represents a single bond, —O—, —S— or a group represented by the following formula:

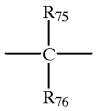

wherein $R_{75}$ and $R_{76}$ are the same or different and each represent a hydrogen atom, a halogen atom, a substituted or unsubstituted alkyl group or a substituted or unsubstituted aryl group; or $R_{75}$ and $R_{76}$ are joined together to form a substituted or unsubstituted cycloalkylidene group together with the intervening carbon atom.

27. The electrophotographic apparatus according to claim 26, wherein $R_{43}$ to $R_{46}$, $R_{63}$ to $R_{66}$, $R_{68}$, $R_{69}$, $R_{71}$ and $R_{74}$ are all hydrogen atoms.

* * * * *

UNITED STATES PATENT AND TRADEMARK OFFICE

CERTIFICATE OF CORRECTION

PATENT NO. : 6,146,800
DATED : November 14, 2000
INVENTOR(S) : Akira Yoshida et al.

It is certified that error appears in the above-identified patent and that said Letters Patent is hereby corrected as shown below:

Column 2,
Line 58, "as not" should read -- not as --;
Line 62, "at the" should read -- at --;
Line 63, delete "has.".

Column 6,
Line 61, "Uinclude" should read -- include --;

Column 8,
Table 1 (A), "-67 $-CH_2-$" $R_1$:$-CH_3$ " " " " "
others: H and
-68 $-C_2H_4-$ $R_1$: $-CH_3$
others: H"
should read -- 67 $-CH_2$-" $R_1$: $-CH_3$ " " " " "
others: H and
68 $-C_2H_4$-" " " " " " " --

Column 9,
Table 1 (A), "-24 " " 10 1 1 1 1 1
-25 " " 20' 1 1 1 1 1 1" should read --
-- 24 " " 10 1 1 1 1 1
-25 " " 20 1 1 1 1 1 --.

Column 20,
Table 2 (A), "$-C_2H_5$ -- should read --" - -" --$C_2H_5$ - - " $-CH_3$ - $CH_3$ --

Column 24,
Line 46, "triethylamihe" should read -- triethylamine --

UNITED STATES PATENT AND TRADEMARK OFFICE

CERTIFICATE OF CORRECTION

PATENT NO. : 6,146,800
DATED : November 14, 2000
INVENTOR(S) : Akira Yoshida et al.

It is certified that error appears in the above-identified patent and that said Letters Patent is hereby corrected as shown below:

Column 26,
Line 56, "photo imagewise" should read --photoimagewise --

Column 28,
Line 7, "23.90°" should read -- 23.9° --.

Column 31,
Table 4, "5.2 Blade 4.0 Blade
turn = turn =
over over" should read
-- 5.2 Blade 4.0 Blade
turn- turn-
over over --

Column 32,
Line 32, "Hullet" should read -- Hewlett --.

Column 37,
Line 12, "and represents" should read -- and ℓ represents --

Column 40,
Line 26, "$R_{75}$ and" should read -- $R_{75}$ and --;

Column 43,
Line 12, "werein" should read -- wherein --;

Signed and Sealed this

Fourth Day of December, 2001

*Attest:*

Nicholas P. Godici

*Attesting Officer*

NICHOLAS P. GODICI
*Acting Director of the United States Patent and Trademark Office*